US008021287B2

(12) United States Patent
Hoffman et al.

(10) Patent No.: US 8,021,287 B2
(45) Date of Patent: Sep. 20, 2011

(54) RESTRAINT, REPOSITION, TRACTION AND EXERCISE DEVICE AND METHOD

(75) Inventors: Swee Lin Hoffman, Sunnyvale, CA (US); Steven Ari Hoffman, Sunnyvale, CA (US)

(73) Assignee: BackProject Corporation, Sunnyvale, CA (US)

( * ) Notice: Subject to any disclaimer, the term of this patent is extended or adjusted under 35 U.S.C. 154(b) by 99 days.

(21) Appl. No.: 11/790,394

(22) Filed: Apr. 25, 2007

(65) Prior Publication Data

US 2008/0269030 A1 Oct. 30, 2008

(51) Int. Cl.
*A63B 26/00* (2006.01)

(52) U.S. Cl. ..... 482/142; 482/143; 482/144

(58) Field of Classification Search ..... 482/142–144
See application file for complete search history.

(56) References Cited

U.S. PATENT DOCUMENTS

| | | | | | |
|---|---|---|---|---|---|
| 1,082,043 | A | * | 12/1913 | Payne et al. | 606/244 |
| 1,390,301 | A | | 9/1921 | McManis et al. | |
| 1,936,363 | A | | 11/1933 | Murray | |
| 2,262,271 | A | | 11/1941 | De Camp | |
| 2,693,796 | A | * | 11/1954 | Warner | 601/98 |
| 2,786,512 | A | * | 3/1957 | Moyer | 297/122 |
| 2,722,929 | A | | 11/1958 | Little | |
| 2,941,526 | A | * | 6/1960 | Mott | 601/18 |
| 2,949,911 | A | * | 8/1960 | Kennard et al. | 601/26 |
| 2,999,496 | A | * | 9/1961 | Parson | 601/51 |
| 3,554,189 | A | * | 1/1971 | Hendrickson | 606/243 |
| 3,685,511 | A | * | 8/1972 | Alvarez | 601/115 |
| 4,271,830 | A | * | 6/1981 | Moon | 606/244 |
| 4,372,552 | A | * | 2/1983 | Carlmark | 482/143 |
| 4,903,689 | A | * | 2/1990 | Lannertone | 606/243 |
| 5,042,800 | A | * | 8/1991 | Walter | 482/142 |
| 5,050,589 | A | * | 9/1991 | Engle | 601/26 |
| 5,074,000 | A | * | 12/1991 | Soltani et al. | 5/611 |

(Continued)

FOREIGN PATENT DOCUMENTS

FR 1108031 1/1956

(Continued)

OTHER PUBLICATIONS

Harrison Chiropractic Biophysics Technique Seminar Book, "History of Lumbar Traction" (Copyright 2004 Harrison CBP Seminars, Inc.) pp. 91-109.

(Continued)

*Primary Examiner* — Allana Lewin
*Assistant Examiner* — Robert F. Long
(74) *Attorney, Agent, or Firm* — Kilpatrick Townsend & Stockton LLP

(57) ABSTRACT

A restraint, reposition, traction, and exercise device treats acute or chronic mechanical pain, particularly back, neck, hip, pelvis, shoulder, knees, and/or leg pain, and restores and/or increases range of motion in suitable users. The device may include two or more movable support structures and two or more restraints, such as straps. The restraints may be incrementally adjustable to stabilize two or more portions of a person's body, such as the back and/or pelvic regions, against the support structures in any number of three-dimensional orientations that produce a substantially pain-free position. The support structures may be moved apart to apply spinal traction to the portions of the person's body between the restraints. Exercises may be performed while in a substantially pain-free position before, during, or after spinal traction is applied. The user may reposition and restrain herself/himself in another substantially pain-free position and then reapply spinal traction and/or perform further exercises.

29 Claims, 12 Drawing Sheets

U.S. PATENT DOCUMENTS

| | | | | |
|---|---|---|---|---|
| 5,110,122 | A * | 5/1992 | Moore et al. | 482/134 |
| 5,224,924 | A * | 7/1993 | Urso | 602/19 |
| 5,334,123 | A * | 8/1994 | Rutherford | 482/144 |
| 5,800,366 | A * | 9/1998 | Bertrand | 601/24 |
| 5,840,001 | A * | 11/1998 | Schedel | 482/142 |
| 5,885,197 | A * | 3/1999 | Barton | 482/144 |
| 5,940,911 | A * | 8/1999 | Wang | 5/610 |
| 5,967,956 | A * | 10/1999 | Teeter | 482/144 |
| 6,243,897 | B1 * | 6/2001 | Sumiya | 5/610 |
| 6,416,447 | B1 * | 7/2002 | Harmon | 482/129 |
| 6,428,033 | B1 * | 8/2002 | Harrison et al. | 280/644 |
| 6,428,497 | B1 * | 8/2002 | Crouch | 602/32 |
| 6,435,611 | B1 * | 8/2002 | Walter | 297/316 |
| 6,565,112 | B2 * | 5/2003 | Hanson et al. | 280/650 |
| 6,637,055 | B1 * | 10/2003 | Nanan | 5/610 |
| 6,656,098 | B2 * | 12/2003 | Hoffman | 482/148 |
| 6,681,770 | B1 * | 1/2004 | Dreher | 128/845 |
| 6,692,451 | B2 * | 2/2004 | Splane, Jr. | 601/5 |
| 6,749,548 | B2 * | 6/2004 | Hoffman | 482/148 |
| 6,811,522 | B1 * | 11/2004 | McQuinn | 482/143 |
| 6,821,288 | B2 * | 11/2004 | Schaeffer | 606/240 |
| 6,971,997 | B1 | 12/2005 | Ryan et al. | |
| 7,052,448 | B2 * | 5/2006 | Teeter | 482/144 |
| 7,081,073 | B1 * | 7/2006 | Smith | 482/145 |
| 7,288,050 | B2 * | 10/2007 | Murphy | 482/92 |
| 7,294,094 | B1 * | 11/2007 | Howle | 482/69 |
| 7,361,128 | B2 * | 4/2008 | Chen | 482/144 |
| 7,534,213 | B2 * | 5/2009 | Shelbourne et al. | 601/5 |
| 2002/0084627 | A1 * | 7/2002 | Harrison et al. | 280/647 |
| 2004/0073150 | A1 | 4/2004 | Roballey | |
| 2006/0003877 | A1 * | 1/2006 | Harmon | 482/142 |
| 2006/0197314 | A1 * | 9/2006 | Harrison et al. | 280/647 |
| 2007/0038162 | A1 * | 2/2007 | Alexiadis | 601/5 |
| 2007/0087921 | A1 * | 4/2007 | Graham | 482/132 |
| 2007/0161477 | A1 * | 7/2007 | Wang | 482/144 |
| 2008/0227610 | A1 * | 9/2008 | Chen | 482/143 |

FOREIGN PATENT DOCUMENTS

| | | |
|---|---|---|
| GB | 862277 | 3/1961 |
| JP | 2001-212163 | 8/2001 |
| KR | 20-0277064 | 6/2002 |
| WO | WO 98/15251 | 4/1998 |

OTHER PUBLICATIONS

Oakley et al. "A History of Spine Traction", J. Vertebral Subluxation Res. Mar. 2, 2007, pp. 1-12.

Harrison et al., "The Lumbar Spine", The Chiropractic Biophysics Approach, 1998, pp. 24-35.

Steve Foster, D.C., "Full Spine Postural Traction in the Five Point Traction System", Sep. 1998, pp. 6-15.

Product information relating to the XZ Traction Wall Unit, and the XZ Traction Wall Unit 3D Traction Wings, Circular Traction Supply, Inc., www.circulartraction.com (date unknown).

Korean Intellectual Property Office, Non-Final Rejection, Application No. 10-2008-0022886, dated Nov. 26, 2009.

Korean Patent Application 10-2008-0022886, Final Rejection mailed Jan. 28, 2011, 4 pages.

* cited by examiner

RESTRAINT, REPOSITION, TRACTION AND EXERCISE DEVICE AND METHOD

BACKGROUND OF THE INVENTION

1. Field of the Invention

This invention generally relates to restraint, reposition, traction, and exercise devices capable of applying a spinal traction force to specific body areas. Various implementations of the invention are envisioned, including its use as a lumbopelvic restraint device during exercise to relieve pain and/or restore range of motion in lower back, pelvis, and leg pain suffers or in healthy persons who wish to restore or increase their range of motion. It may also be used to treat pain and/or restore or increase range of motion in the neck, shoulders, upper back, middle back, pelvis, hips, knees, and other body parts.

2. Related Art

In the human anatomy, the lower spine, known as the lumbar spine, is joined to the pelvic bone at a joint known as the sacroiliac joint. The sacro-iliac joint is a relatively stiff or rigid joint. The upper leg bone, known as the femur, is joined to the pelvic bone at the hip joint by means of hip ligaments. Only a limited degree of movement of the lumbar spine relative to the pelvis is possible at the sacro-iliac joint, due to the relatively stiff or rigid nature of this joint. Thus, in general, upon movement of the lumbar spine in any direction, at least some of this movement is translated into a movement of the pelvis at the hip joint. This is because the hip joint is relatively free-moving in comparison to the stiff sacro-iliac joint. Upon movement of the leg, at least some of the hip ligaments start to wind up. When these hip ligaments are fully wound up, further movement of the leg is translated into a movement of the pelvis.

A major and longstanding health problem that spans the world is acute or chronic back pain. A countless number of people suffer from pain in the lumbopelvic region including their lower back and hip. The causes of back pain are too numerous to enumerate, but include injuries, bad posture, accidents, genetic defects, disease, and aging. For some, the pain arises only during exercise. As a result, many eliminate beneficial exercises from their routines. For others, hip and/or lower back pain is always present. Exercise may be a desirable or a necessary treatment for the pain for many of these people. But again, the very exercises needed to alleviate the pain are difficult to perform due to the increased pain during exercise. These people often become stuck in a cycle of increasing pain as the exercises and treatments needed to alleviate pain are too painful to perform, with the lack of proper exercise resulting in weakening of the muscles and increased pain and/or discomfort.

The amount of money and effort spent on trying to cure back problems and/or alleviate the pain and/or discomfort is staggering. Modern medical attempts to address these issues, including drugs, surgery, traction, manual mobilization and exercise, are costly and have met with little success. There is no doubt there is a longstanding need for a safe, reliable and cost effective way to solve the problems associated with lumbopelvic back pain and disorders. Also, there is no doubt that the numerous attempts by others to meet this need and solve these problems have largely been failures.

Pelvic restraint devices have been proposed for various uses, such as those disclosed in U.S. Pat. No. 3,709,216 to Hilyard et al.; U.S. Pat. No. 4,678,186 to Mcintyre et al.; U.S. Pat. No. 5,094,249 to Marras et al.; and U.S. Pat. No. 5,474,086 to McCormick et al. Among other deficiencies, none of the proposed devices suggests an apparatus capable of positioning the pelvis with six degrees of freedom in any of a number of three-dimensional positions to find a substantially pain-free position in which the pelvis may be subsequently restrained by the apparatus, and from which exercises can be performed in a substantially pain-free manner. In brief, they do not disclose a mechanical device capable of eliminating pain, exercising in a pain-free position, and directing movements to the affected joint or region of the body. In addition, these and similar devices may suffer from one or more additional drawbacks. First, the number of exercises available to the user is limited. Second, some of the devices are not user-friendly. Third, some of the devices are unable to conform to a user's build and preferences. Fourth, the devices do not do a sufficient job of preventing pain in the user.

The assignee of this invention has patented and commercialized unique devices and methods to meet the foregoing needs by allowing body areas to be simultaneously positioned and repositioned with six degrees of freedom to find a substantially pain-free position in which the body area may be restrained. With the body area restrained in a substantially pain-free position, therapeutic exercises may be performed. See assignee's prior U.S. Pat. Nos. 6,656,098 and 6,749,548, the disclosures of which are incorporated by reference herein in their entirety. The assignee has also marketed devices that practice the teachings of these patents, including the ATM2, which allows for body areas to be simultaneously repositioned and compressed while in a functional weight-bearing upright position. The ATM2 has produced remarkable and immediate results in terms of elimination or reduction of pain and restoration or increased range of motion in some suitable users.

The invention is an improvement over the assignee's prior patented devices and methods, such as the ATM2 device, in that it may include all the functionality of the ATM2 device, but also allows for spinal traction forces to be applied to certain body parts while adjacent body areas are simultaneously repositioned and compressed. While many traction systems exist in the market today, they provide for decompression of the entire spine by application of spinal traction between two regions of the body, ordinarily between the armpits and hips, and have no ability to apply traction forces to any other selected body regions. Moreover, there is no system available today that allows for application of spinal traction forces to selected body regions for decompression of less than the entire spine and certainly not while permitting adjacent body areas to be repositioned and compressed while in a functional weight bearing position. Accordingly, there is a need for a device that can apply spinal traction forces between various, specific locations on a user's body, including without limitation, between the groin, hips, abdomen, chest, and shoulder regions. In addition, the conventional traction systems do not allow a user's spine to be decompressed in substantially upright (vertical), or substantially horizontal, or angled positions between vertical and horizontal. Furthermore, there is a need for a traction system that allows for users to do specific exercises once repositioning, compression, and traction are applied.

SUMMARY OF THE INVENTION

The invention meets the needs described above for a vast number of suitable back, pelvis, neck, shoulder and/or leg pain suffers, and avoids the problems and disadvantages of the prior art, by provision of a mechanical device that allows a user, with or without the help of a physician, clinician, physical therapist or other healthcare professional, to position and stabilize his/her body in a substantially pain-free position. The stabilized position of the body is then restrained so as to maintain its substantially pain-free position while performing spinal traction between selected body regions such as the between the groin, hips, abdomen, chest, and shoulder regions.

For example, specific vertebral segment traction may be achieved by applying independent elevation to either the left or right side of a person, while allowing for the restrained body portions above and/or below the area to which traction is applied to be repositioned and compressed, e.g., while the user is in a fully functional weight bearing (upright) position, with six degrees of freedom. This unique combination of application of traction forces along with repositioning and compression allows patients to find a greater number of substantially pain-free positions and/or a range of positions that are more pain-free than obtainable without traction forces. In addition to providing for targeted spinal decompression to be performed while the user is in a substantially upright (vertical) position, the invention may provide for spinal decompression in a substantially horizontal position, or any angled position between horizontal and vertical.

Exercises of other body parts relative to the restrained region may be performed substantially or completely pain-free. In particular, exercises may now be directed to the specific area of the body region that has been causing pain. Applicants believe that, in some suitable users, these and other similar exercises will produce the same type of remarkable and immediate results in terms of elimination or reduction of pain and restoration or increased range of motion that have been achieved by suitable users of the ATM2 device. Like the experience with the ATM2, the user may experience a long-lasting increase in range of motion and/or strength.

The principles of invention may be implemented in a number of ways. Accordingly, in one aspect of the invention a spinal restraint, traction and exercise device includes a first support surface configured to support a first portion of a person, a first restraint to secure the first portion of the person against said first support surface, a second support surface to support a second portion of the person, a second restraint to secure the second portion of the person against said second support surface, said first and second restraints permitting positioning and repositioning of the person against said support surfaces in any of a number of three-dimensional orientations, and an adjustment mechanism to move said second support surface relative to said first support surface to apply a spinal traction force.

At least one said support surfaces may be configured to support the person in a substantially horizontal, substantially vertical, or an angled position. A locking mechanism may be configured to keep said first and said second support surfaces apart and maintain a spinal traction force between the first portion and second portion of the person. The locking mechanism may include a self-locking threadable connection forming at least a part of said adjustment mechanism, and may be operable to keep said first and second support surfaces apart in a number of spaced positions.

The second support surface may be raised or lowered with respect to said first support surface to maintain the restrained portions of the person's body in a substantially pain-free position while applying spinal traction. The second support surface may include at least two sections individually movable relative to said first support surface. The at least two sections may include a right section and a left section, and at least one of said right section and said left section may be movable along a track system away from said first support surface to apply a traction force between the first portion and second portion of the person.

The adjustment mechanism may include an actuator arranged to move said second support surface along said track system, and the actuator may include at least one of a manually operated mechanism and an electric motor. The adjustment mechanism may include at least two actuators, with each actuator being operable to move one of said two sections. The tension in at least one of said first restraint and said second restraint may be adjustable.

A support structure may carry said first and second support surfaces, with said support structure being arranged on and movable along at least one member to adjust the position of said support structure relative to the height of the person. The track system may include at least one track fixed to said support structure and at least one track fixed to one of said first and second support surfaces, and wherein said tracks matingly fit together to guide movement of said first and second support surfaces relative to one another.

The first and second restraints may be independently adjusted relative to the height of the person and relative to said support structure. Each of said restraints may include at least one connection connecting the restraint to said support structure, with said at least one connection allowing for independent adjustments in the tension of the restraint. The at least one connection may include a ratchet mechanism allowing for adjustments to be made to a precision of at least about 7 to 8 millimeters or less without release of any tension in the restraint. Each of said first and second restraints may include a pair of restraining members. A third restraint may be configured to be engaged between the person and a connection portion of said device such that the person is able to exercise by moving against resistance provided by at least one of said third restraint and said connection portion.

The support surfaces may include cushioned pads. At least one of said support surfaces may be angularly adjustable, e.g., by the use of at least one of i) wedges disposed between said at least one support surface and the person; and ii) a mechanism to pivot said at least one support surface about a substantially horizontal axis.

According to another aspect of the invention, a method of applying spinal traction forces to a person's body includes the steps of: positioning a first portion of the person's body in a first position; positioning a second portion of the person's body in a second position; restraining the first and second body portions in any number of three-dimensional orientations; and applying a spinal traction force by using a mechanical device to move the first and second body portions apart.

The method may further include the steps of: repositioning the first portion of the person's body in a third position; repositioning the second portion of the person's body in a fourth position; re-restraining the first and second body portions in any number of three-dimensional orientations; and re-applying a spinal traction force by moving the first and second body portions apart.

The method may further include the step of performing exercises while restraining the first and second body portions in a substantially pain-free orientation. The exercises may be performed while applying a spinal traction force. The three-dimensional orientations may include a substantially pain-free orientation, and the step of performing exercises may occur while re-restraining the first and second body portions in a substantially pain-free orientation and/or while re-applying a spinal traction force.

The first portion may be an upper portion of the person's back and the second portion may be a lower portion of the person's back. The step of applying a spinal traction force may include applying spinal traction between the upper portion of a person's back and the lower portion of a person's back.

At least one of said positioning steps may include positioning the body in a substantially horizontal, substantially vertical, or an angled position. The first and second positions may be generally vertical positions and the spinal traction force may be applied while the person is in a generally upright, weight bearing position. At least one of the positioning steps may include the step of positioning the body portion relative to an angled support surface. The method may further include the step of maintaining application of the spinal traction force by locking the mechanical device in any number of continuously variable positions.

According to yet another aspect of the invention, a spinal restraint, traction and exercise device includes first means for supporting a first portion of a person in a first position, first means for restraining the first portion of the person, second means for supporting a second portion of the person, second means for restraining the second portion of the person, said first and second means permitting positioning and repositioning of the person in any number of three-dimensional orientations; and means for moving said first supporting means relative to said second supporting means to apply a spinal traction force.

At least one said first and second supporting means may be configured to support the person in a substantially horizontal, substantially vertical, or an angled position. Means for locking said first and second supporting means in a spaced position to maintain application of the spinal traction force may also be provided.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention, are incorporated in and constitute a part of this specification, illustrate embodiments of the invention and together with the detailed description serve to explain the principles of the invention. No attempt is made to show structural details of the invention in more detail than may be necessary for a fundamental understanding of the invention and the various ways in which it may be practiced. In the drawings.

DETAILED DESCRIPTION OF THE INVENTION

Figure 1:
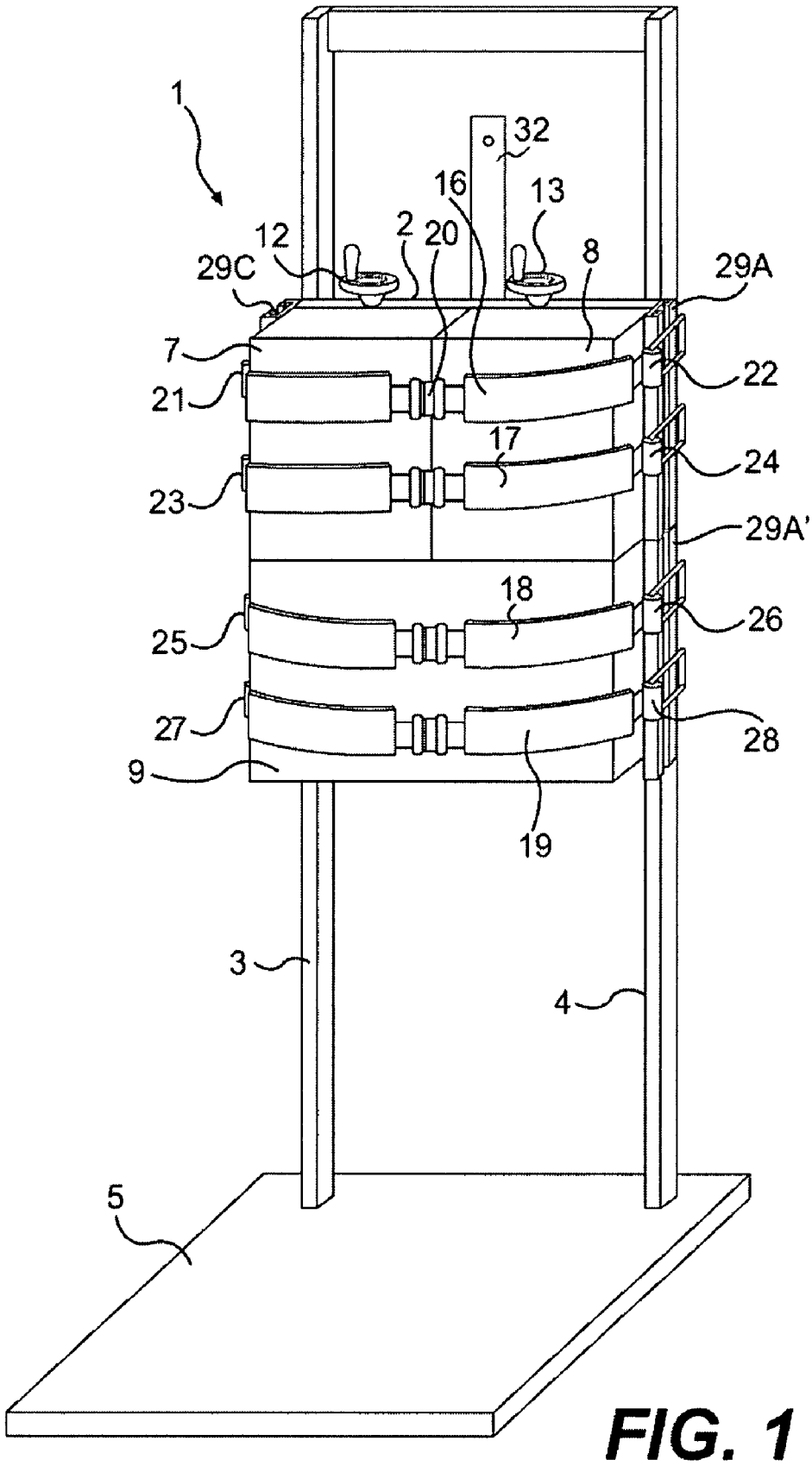
FIG. 1 is a perspective schematic view of one embodiment of a restraint, reposition, traction, and exercise device having movable support pads constructed according to the principles to the invention.

The embodiments of the invention and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments of the invention.

The examples used herein are intended merely to facilitate an understanding of ways in which the invention may be practiced and to further enable those of skill in the art to practice the embodiments of the invention. Accordingly, the examples and embodiments herein should not be construed as limiting the scope of the invention, which is defined solely by the appended claims and applicable law. Moreover, it is noted that like reference numerals represent similar parts throughout the several views of the drawings.

Hereinafter, the term "traction" will be used to describe the application of any tension or pulling force on a skeletal system, including forces that cause spinal decompression. Traction may be used to relieve pressure on the skeletal system.

The drawings illustrate various embodiments of a device for holding the back, hips, and pelvis of a user in any of a number of substantially fixed positions while applying spinal traction. This device may also be used during leg, back, neck or shoulder exercises, for example. During back exercises, the user's spine and the user's pelvis are substantially inhibited from pivoting about the hip joint. Instead, most of the exercising movement of the user's back is translated into a pivoting of the spine itself, and about the pelvis at the sacro-iliac joint. Similarly, during leg exercises the device ensures that substantially all movement of the leg is translated into a pivoting of the leg about the pelvis. In this case, the user's pelvis is substantially inhibited from pivoting about the sacroiliac joint and lumbar spine. In other cases, the restraining belts can be used to inhibit movement from spinal segments between the belts, and facilitate movement at other segments above or below the belts. The user may be a patient suffering from pain or a healthy person who wishes to perform exercises that may increase range of motion and/or strength.

In order to increase its therapeutic effect, the device is adjustable to help position and secure the user in a substantially pain-free position. Hence, those who previously had to endure pain—even excruciating pain—may be able to perform subsequent exercising movements on the device in a substantially pain-free manner. The therapeutic effects on suitable users from performing these substantially pain-free exercises have been dramatic in terms of reduction of pain and/or increase in range of motion. Applicants believe that, in some cases, the results may be immediate and completely eliminate pain and/or restore full range of motion of users having chronic pain after a short period of treatment with the invention.

FIG. 1 illustrates a first example of a restraint, reposition, traction, and exercise device of the invention that may provide spinal traction of specific vertebral segments of a human while in a substantially upright, weight bearing position. Further, exercises may be performed when a user is restrained and experiencing spinal traction. As shown in FIG. 1, a restraint, reposition, traction, and exercise device 1 may include a carriage 2 that holds support pads 7, 8, and 9, in a manner described subsequently. The carriage 2 may be slidably coupled with legs 3 and 4. The legs 3 and 4 are rigidly connected to base 5. The base 5 is sufficiently wide to ensure that the device 1 is stable even when a user is exercising on it. As shown in FIG. 1, the base 5 may be configured to define a platform on which the user stands in a substantially upright, weight bearing position when the user's back and/or pelvis is clamped against the support pads 7, 8, and/or 9. The user's body weight will thus further stabilize the device 1.

Figure 2:
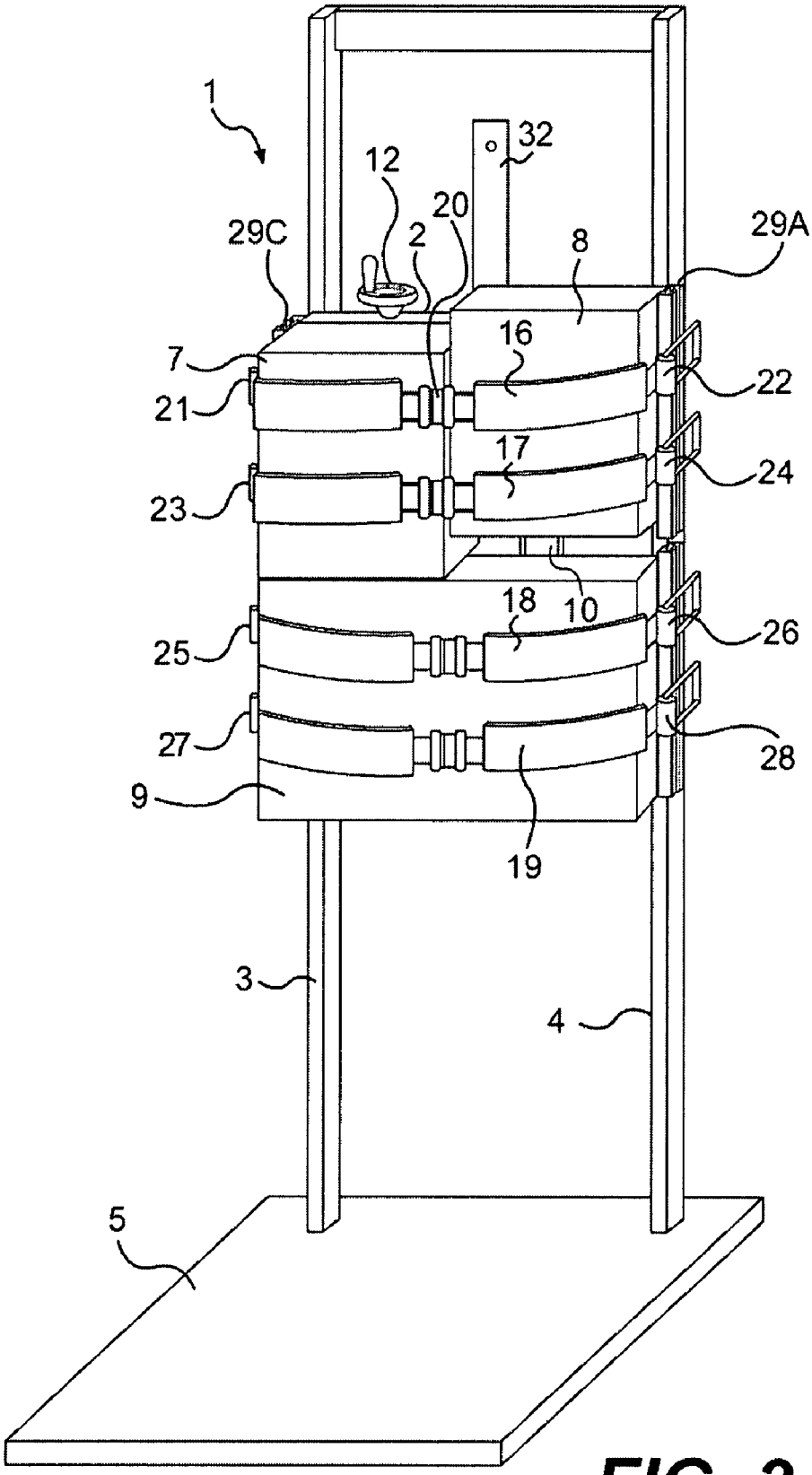
FIG. 2 is a perspective schematic view of the device in FIG. 1 showing one of the upper support pads raised with respect to a lower support pad.
Figure 3:
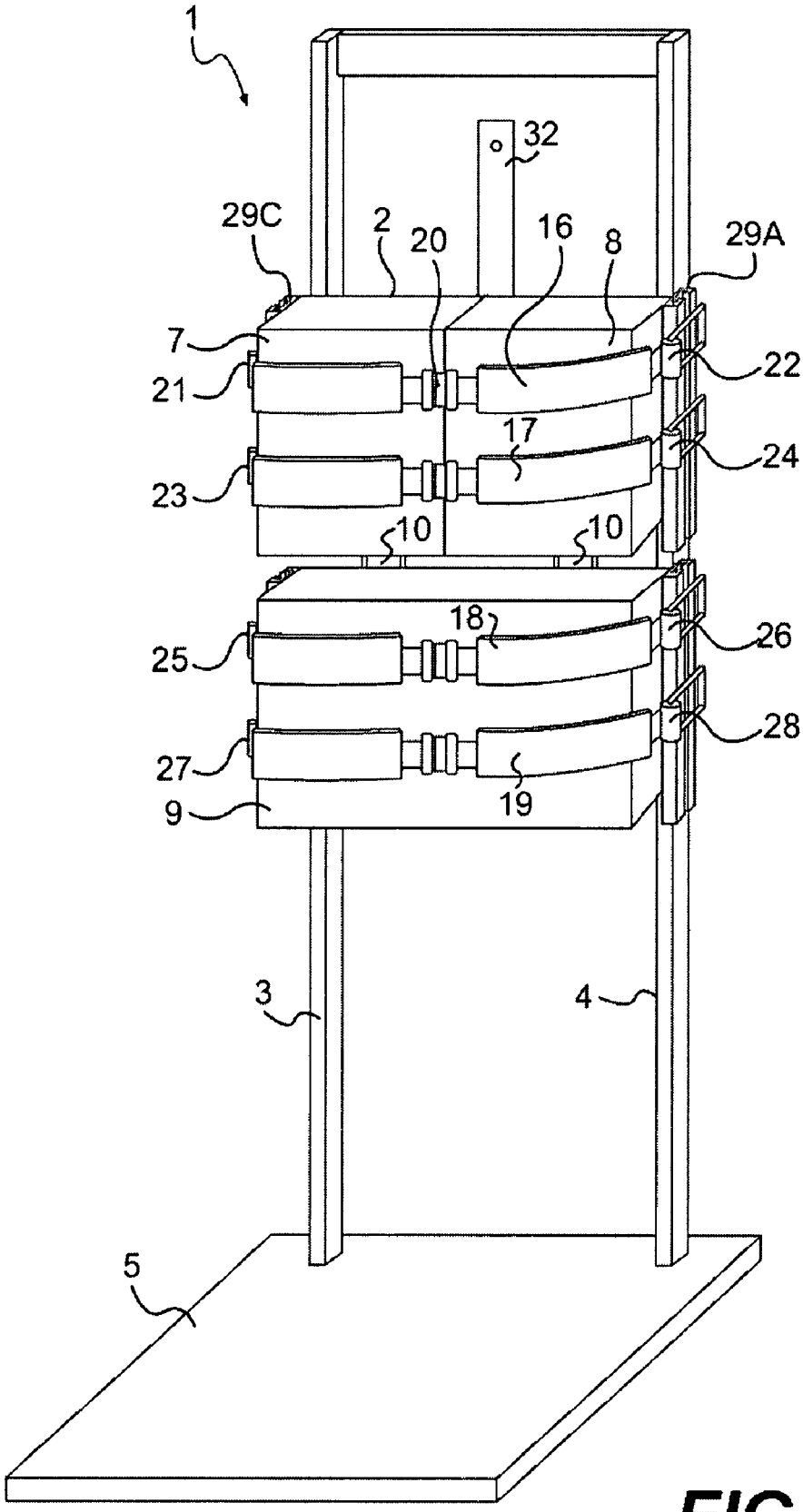
FIG. 3 is a perspective schematic view of the device in FIG. 1 showing two upper support pads raised with respect to a lower support pad.

To use the device 1, a user steps onto the base 5 and positions his/her body into any number of three dimensional positions to find a substantially pain-free position with his/her back or front and pelvis pressed against support pads 7, 8, and/or 9. Then, the user and/or a clinician restrains himself/herself to the device 1 using straps 16, 17, 18, 19, while still maintaining the substantially pain-free position, as shown e.g., in FIG. 8. As illustrated in FIGS. 2 and 3, once the user is strapped into the device 1, the support pads 7, 8 may be independently raised in a manner that will be described in detail later to apply spinal traction, while suiting the preferences and characteristics of the user. For example, only support pad 8 may be raised, as shown in FIG. 2, or only support pad 7 may be raised. Both support pads 7 and 8 may also be raised, as shown in FIG. 3. In this manner, spinal traction occurs in the segment of the spine that is disposed between belts 17 and 18 as support pad 7 and/or 8 are raised. For example, when the user is facing away from support pads, if only support pad 8 is raised, spinal traction will be applied on the user's left side in the region between straps 17 and 18. If only support pad 7 is raised, spinal traction will be applied on the user's right side in the region between straps 17 and 18. If both support pads 7 and 8 are raised, spinal traction will be applied on both sides of the user in the region between straps 17 and 18. The details of the carriage that supports the pads 7, 8, 9 for relative movement will now be described.

Figure 4:
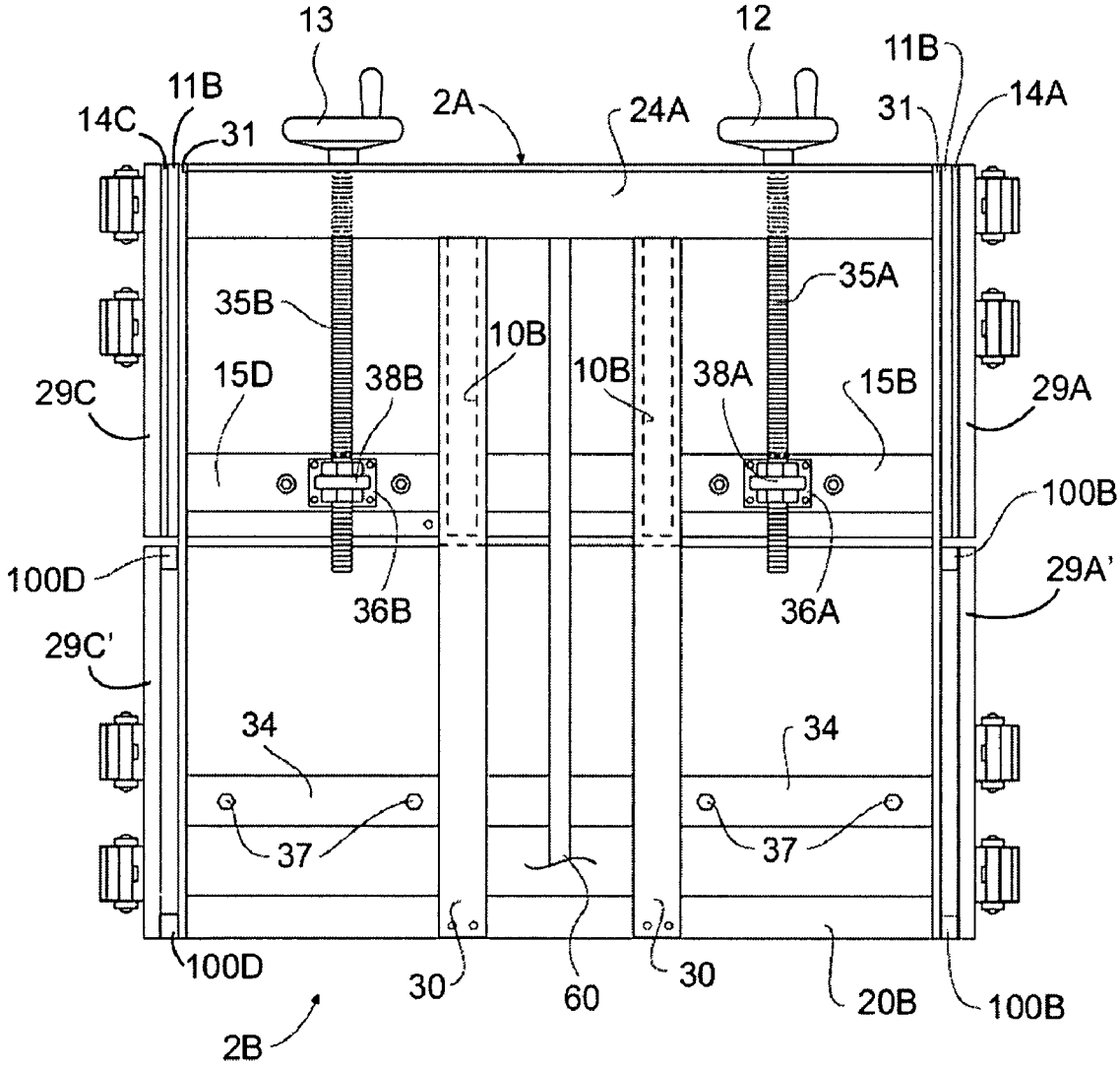
FIG. 4 is a back view of a portion of the device of FIG. 1 showing a carriage having support tracks for slidably supporting the upper pads relative to the lower pads.
Figure 5A:
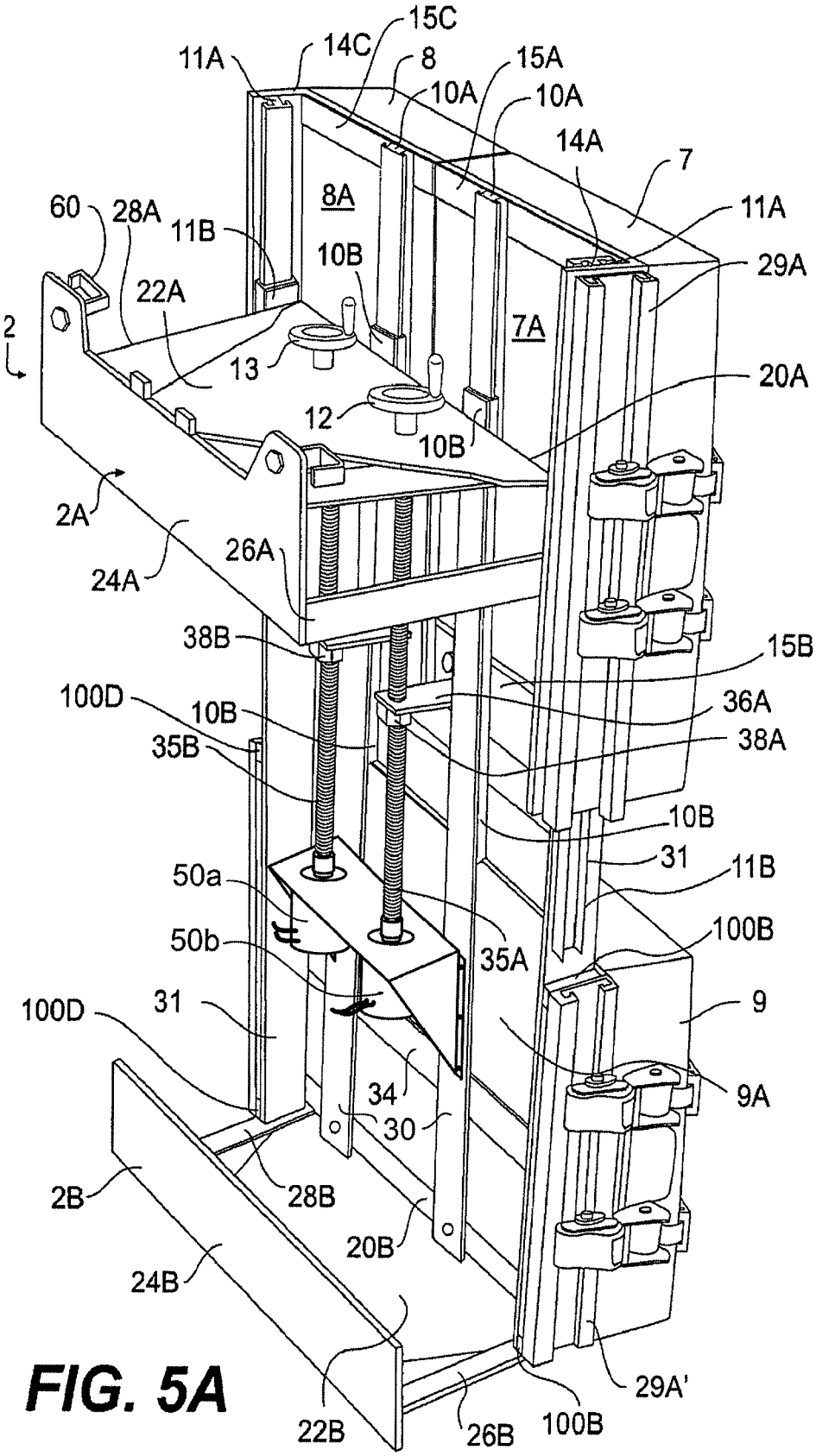
FIG. 5A is a perspective schematic, partially cut-away view of the device shown in FIG. 4 illustrating the carriage and the sliding connection between the carriage and upper support pads of the invention.

FIG. 4 is a back view of a portion of the device shown in FIG. 1 that shows the components of the carriage 2 in detail, while FIG. 5A is a perspective view of the carriage and support pads illustrating the sliding connection between the carriage and the upper pads 7, 8.

As shown in FIGS. 4, 5A, the carriage 2 includes top and bottom platforms 2A and 2B, respectively, which are fixedly connected together by a series of longitudinally extending plates 30 and 31. The platforms and the plates may be made of suitable, durable material, such as steel or other metals, that may be fixedly connected by any fastening means known in the art, such as welds, rivets, bolts, screws, etc. Top platform 2A has a front 20A, top 22A, back 24A and sides 26A and 28A. Front 20A is not visible in FIG. 5A but consists of a downwardly depending lip adjacent the back surfaces 7A and 8A of the support pads 7, 8. Sides 26A and 26B extend between and connect the front 20A and back 24A of top platform 2A. The bottom platform 2B has a front 20B, top 22B, back 24B and sides 26B and 28B extending between and connecting the front 20B and back 24B of bottom platform 2B. Two plates 30 extend between and connect the top and bottom platform 2A and 2B in the middle of the carriage, such as by one or more fasteners, such as welds, rivets, bolts, etc. schematically shown in FIG. 5A connecting the bottom of plates 30 to the upwardly extending lip 20B forming the front of bottom platform 2B. The top portions of plates 30 are similarly connected to the downwardly depending lip forming the front 20A of top platform 2A, but the connection is not visible in FIGS. 4, 5A. At the sides of the carriage are two more plates 31, which extend between and connect the respective sides of the top and bottom platforms together, again by any conventional means known in the art to produce a fixed connection. Thus, one of the plates 31, (shown at the right side of FIG. 4) extends between and connects the sides 26A of top platform 2B to the side 26B of bottom platform 2B, while the other plate 31 (shown at the left side of FIG. 4) connects the side 28A of top platform 2A to the side 28B of bottom platform 2B. In this manner, the platforms and plates form a substantially rigid, open box-like structure suitable for carrying the support pads 7, 8, 9 as described subsequently. The carriage 2 may include one or more cross members providing lateral support such as a lateral plate 34, which may be fixedly connected to and extend between side plates 31.

The support pad 9 may be fixedly connected to the carriage in any manner known in the art. FIGS. 4, 5A illustrate the support pad 9 formed with a suitable backing 9A, which may be fixedly attached to lateral plate 34 such as by fasteners 37 shown in FIG. 4. The top pads 7, 8 are each slidably connected to the carriage for independent relative movement thereto. FIGS. 4, 5A illustrate a slidable track system for guiding the relative movement, but any known mechanism to achieve the desired relative movement may be employed.

Figure 5C:
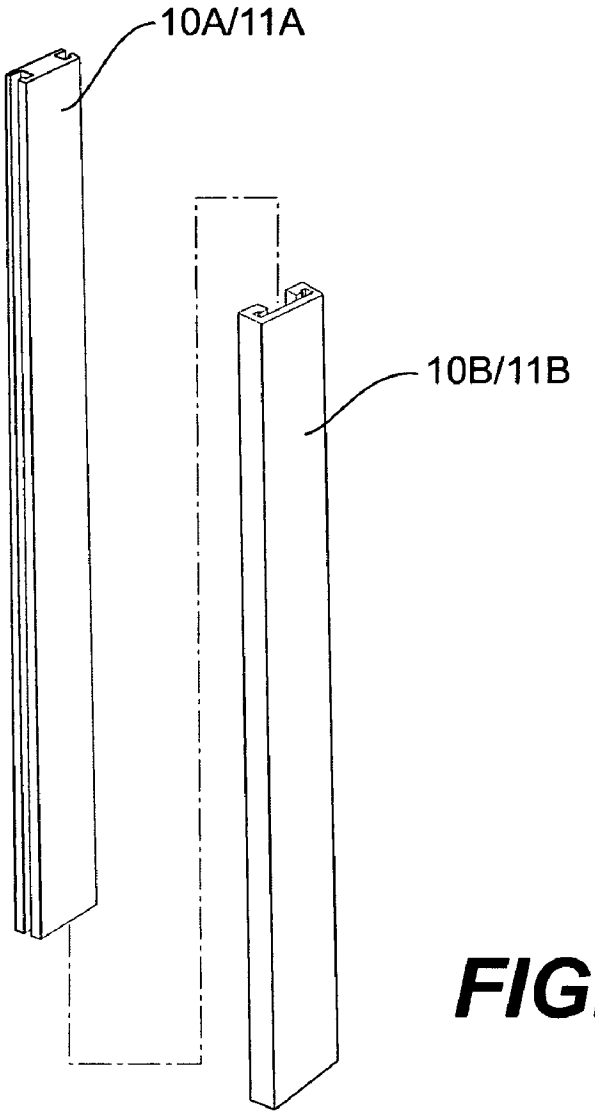
FIG. 5C is an exploded, perspective view of the support tracks of FIG. 5B.
Figure 5B:
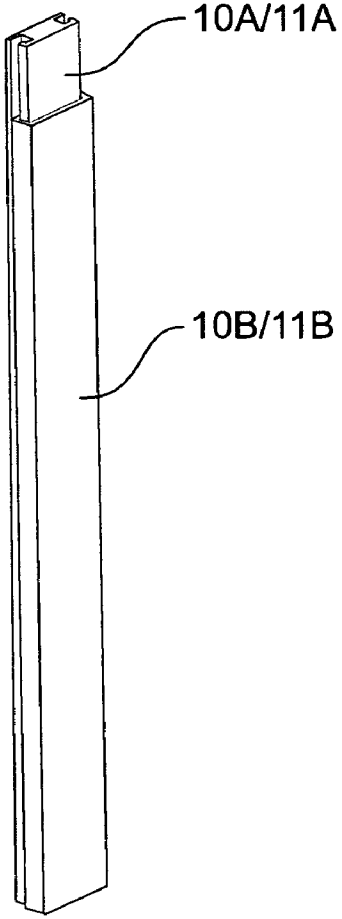
FIG. 5B is a perspective schematic view of one embodiment of one set of slidable support tracks that may be used to guide relative movement according to the invention.

FIGS. 5B and 5C show an example of a slidable track system that may be employed for this purpose. The male portion 10A/11A of the track system is slidably coupled to a complementary female portion 10B/11B as shown, e.g., by having matching cross sections such as the generally T-shaped male cross section 10A/11A, which is captured within the complementarily shaped recess of female unitrack member 10B/11B, which has a generally C-shaped cross section. Slidable movement is permitted by fixedly connecting the male track inserts to one of the support pads and carriage and fixedly connecting the female unitrack to the other of the support pads and carriage. The tracks may be formed of metal or other suitable material.

For example, referring again to FIGS. 4 and 5A, two female tracks 10B and two female tracks 11B are fixedly connected (by any means known in the art) to the middle and sides of the carriage 2, respectively, and there are two corresponding male tracks 10A and 11A fixedly connected (by any means known in the art) to the middle and sidewings of each of the pads 7, 8.

More specifically, each middle female track 10B is fixedly connected to one of the middle plates 30 and may extend from a position substantially flush with the top 22A of top carriage platform 2A along the vertical height of pads 7, 8 to the bottom of pads 7, 8, as shown in dashed lines in FIG. 4. Similarly, each side female track 11B is connected to outer surface of one of the side plates 31 and may extend from a position substantially flush the top of each pad 7, 8 along the vertical height of the pads to the bottom of pads 7, 8, as shown best in FIG. 4. Note that the top portions of three of the female tracks 10B, 11B visible in FIG. 5A are shown disposed above the top 22A of carriage platform 2A for ease of illustration only and it is preferred that the female tracks not extend above top 22A, but be substantially flush therewith, as noted above. The male tracks 10A and 11A may be fixedly connected to the pads 7, 8 in positions corresponding to a respective female track 10B/11B in the following manner. Pad 7 may include one or more rigid backings, such as metal plates 15A, 15B which are disposed at its top and bottom, and are connected to back surface 7A of pad 7, as shown best in FIG. 5A extending across the width of pad 7. Another metal plate called a sidewing 14A is fixedly connected between the plates 15A, 15B (by welding or any other known means) and extends backwardly from back surface 7A of the pad 7 along the full vertical height of the pad 7. Alternatively, plates 15A, 15B could be replaced by a single backing extending across the back surface of 7A. The sidewing 14A forms an attachment surface as discussed below. Pad 8 has similar parts, include metal plates 15C, 15D connected to back surface 8A and a sidewing 14C fixedly connected between the plates 15C, 15D and extending backwardly to form an attachment surface.

As shown best in FIG. 5A, the male tracks 10A are fixedly connected to and extend between the backing plate 15A and 15B for pad 7 and between plates 15C and 15D for pad 8 such that they extend substantially along the full vertical height of the pads 7, 8. Each male track 11A is fixedly connected to the inner surface of one of the sidewings (sidewing 14A for pad 7 and sidewing 14C for pad 8) and also extend substantially along the full vertical height of the pads. The outer surface of each sidewing 14A, 14C is used to attach unitracks 29A, 29C, respectively, which slidably carry one or more ratchets (or any other suitable tightening mechanism(s)), as discussed subsequently.

In this manner, the male tracks 10A, 11A may be received in the corresponding recesses of female tracks 10B/11B, respectively, to guide sliding movement of pads 7, 8 relative to the carriage 2. Raising and lowering the pads 7, 8 may be done independently to apply spinal traction by any means known in the art such as the simple crank mechanism described below. The carriage 2 may also include a damping cylinder, such as gas spring 60 partially shown in FIG. 4 (or any other known device to damp movement) connected between the carriage 2 and a suitable, fixed portion of the device, such as the legs 3, 4 or base 5, for easing the raising and/or dampening the lowering movement of the carriage 2B, as discussed subsequently. The entire carriage 2 including movable pads 7, 8 and fixed pad 8 may be moved as a unit up and down along posts 3 and 4 by the use of quick release mechanisms, the handle portion of which is shown at 60 in FIG. 5A, and described in more detail subsequently.

As shown in FIGS. 4 and 5A, cranks 12 and 13 may be provided at the top of the carriage 2 to provide the forces necessary to raise or lower the support pads 7 and 8 along support tracks 10 and 11. The cranks 12 and 13 may each be connected to a long threaded bolt 35A, 35B, respectively, and extend through a hole in top 22A. The bottoms of the bolts are coupled with support pads 7 and 8, respectively, via brackets 36A, 36B, respectively, that include a nut 38A, 38B, respectively, which may be double (FIG. 4) or single (FIG. 5A) nuts fixable secured to their respective brackets. The brackets 36A, 36B are welded or otherwise fixedly secured to back of the support pads 7, 8, e.g., plates 15B, 15D, respectively. The bolts 35A, 35B and the cranks 12 and 13 are mounted to the top 22A for rotation relative to the carriage by any means known in the art, such as threaded holes. In this manner, when a crank 12, 13 is turned manually by a user, its bolt is also turned around its threads. Rotation of the bolts 35A, 35B causes the respective bracket 36A, 36B to move up or down along its respective bolt 35A, 35B and carry the support pad 7 or 8 with it. This turning of bolt 35A or 35B causes its corresponding support pad 7, 8 to move vertically along the bolt's threads as the carriage 2 (and pad 9) remains in a fixed position. The support pads 7 and 8 can be either raised or lowered using the cranks 12 and 13. The threadable connection between the bolts 35A, 35B and the nuts 38A, 38B, respectively, are self-locking such that once rotation of the crank ceases, the corresponding pad is locked in its current vertical position. Other means known in the art for locking the pads in a spaced apart position may be employed. In this way, the height of each support pads 7 and 8 is independently adjustable with respect to each other. FIG. 5A shows both support pads 7, 8 being raised to the same degree relative to the pad 9, and a gap exists therebetween. Although FIGS. 4 and 5A and the above description detail the use of cranks 12 and 13 and threaded bolts, any known mechanism or means for raising or lowering the support pads 7 and 8 may be used in this invention, including, e.g., an electric motor such as motors 50*a* and 50*b* operatively associated with the frame and carriage 2 and/or with pads 7, 8 to allow motorized movement of the carriage 2 and/or pads 7, 8 relative to the frame.

As noted above, support pad 9 is shown to be stationary, and not movable relative to the carriage 2. In an alternate embodiment, however, support pad 9 may also be raised and lowered along its own support tracks or other mechanism to apply a wider range of spinal traction. In addition, support pads 7 and 8 may be combined into a single wider support pad or be separated into three or more support pads to span the width of the device 1. Further, support pad 9 may be separated into two or more support pads that span the width of the device 1, thus allowing more specialized spinal traction. Support pads 7, 8 and/or 9 also may be rotated about, e.g., a substantially horizontal axis, to angle the working surface of the pad relative to the used and facilitate attaining additional substantially pain-free positions.

As mentioned above, the carriage 2 is coupled with legs 3 and 4, which may be made of metal (for instance, steel). For example, the carriage 2 may be slidably secured to legs 3 and 4 so as to be movable up and down along legs 3 and 4 and then be fixedly secured in position, e.g., by suitable quick release mechanisms, at any position in order to adjust the height of the carriage 2 and pads 7, 8, 9 to the user. Thus, the carriage 2 can go up and down relative to the base 5 along legs 3 and 4.

Figure 6:
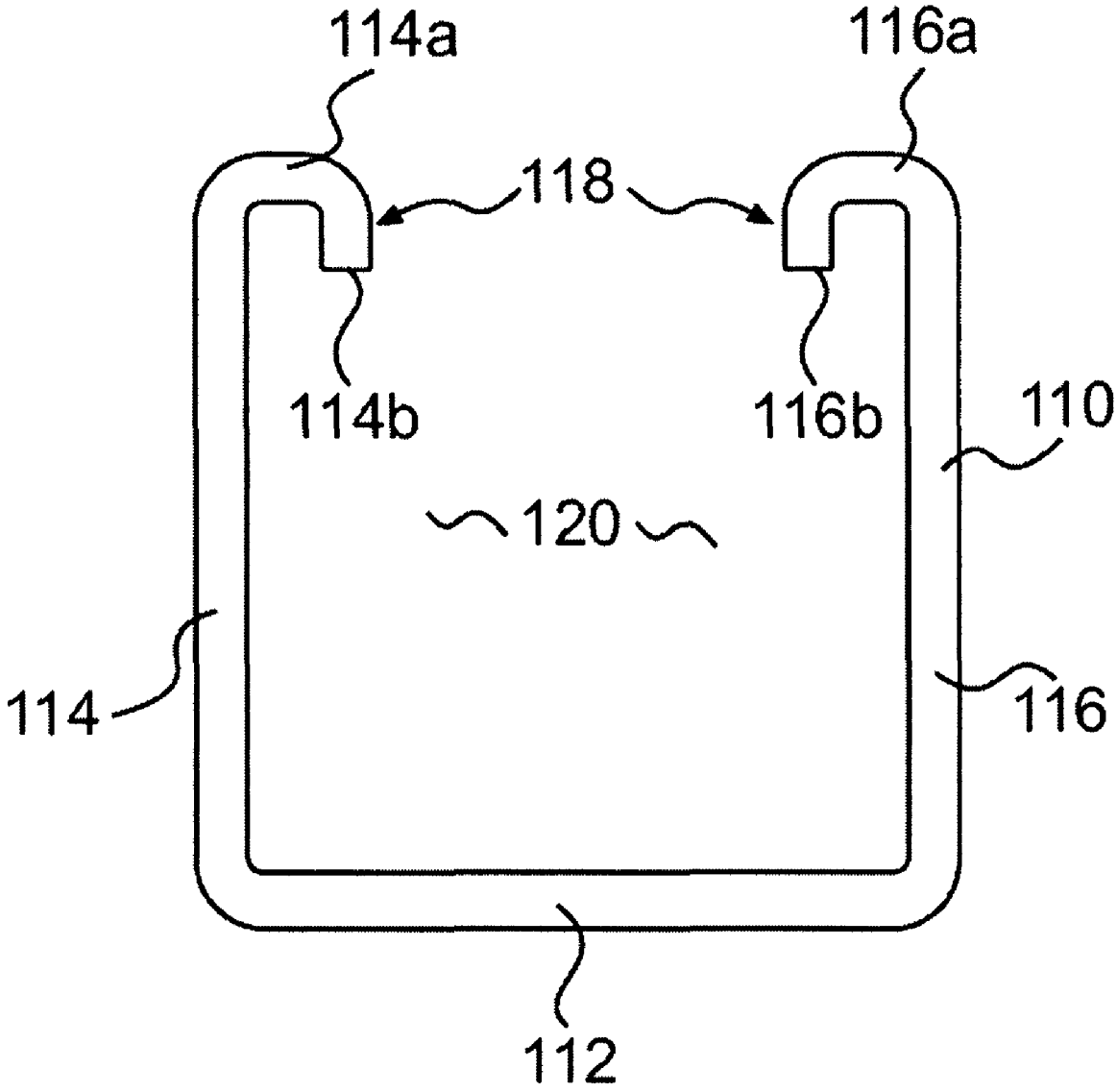
FIG. 6 is a plan view of a unitrack member that may be used to slidably support the carriage of the invention on the support posts shown in FIGS. 1-3.

Movement of the carriage 2 up and down along legs 3 and 4 may be accomplished in many ways. For instance, carriage 2 may be slidably mounted on legs 3 and 4 via quick release mechanisms or any other mechanism known in the art to permit lockable height adjustments. Legs 3 and 4 could include or be formed from one, two, or more unitracks, i.e., a member having an elongated recess, as illustrated in FIG. 6. The carriage 2 may include a member projecting into and slidably retained within the recess 120 of the unitracks, thus allowing the carriage 2 to move up and down along the unitracks. One or more of the projecting portions of the carriage 2 could include a quick release mechanism, similar to the quick releases used on bicycles to mount the wheels to the frame. The release acts as a latch to lock the carriage 2 into place at a desired height. When the release is unlocked, the carriage 2 is able to move up and down along the unitracks on legs 3 and 4. An example of a suitable unitrack and quick release mechanism is shown and described in detail in FIGS. 8A-8-C and the accompanying text of the assignee's prior U.S. Pat. Nos. 6,656,098 and 6,749,548. The handle and bolt of such a device are schematically shown in FIG. 5A at 60.

In addition, a damping cylinder, such as gas spring 60 discussed above, may be associated with legs 3 and/or 4 to facilitate the lifting of carriage 2 and/or to prevent the carriage from falling too quickly upon release of the quick release mechanisms. In another example, legs 3 and 4 may itself be or incorporate a damping cylinder, and support pads 7, 8, and/or 9 may be fixedly secured to legs 3 and 4.

Although the carriage 2 has been described as being attached to legs 3 and 4 which are connected to a base 5, carriage 2 may also be attached to a rigid supporting structure, such as a wall, a door, a floor, or an exercise machine (for example a weight machine), as long as the rigid structure includes a mechanism permitting the carriage 2 to move up and down in lockable positions. If so attached, the base 5 may not be required. Any appropriate means may be used to attach the carriage 2 to the rigid support structure. For instance, a recess could be provided in the side of the carriage 2 opposite the support pads 7, 8, and 9. The recess would mate with a corresponding protrusion, such as a hook, on the supporting structure. In the alternative, a conventional bracket or any other appropriate means could be used.

The side of each support pad includes one or more adjustable ratchet mechanisms 21-28 that are slidable mounted to the pads to adjust the position and tension in a holder, such as straps, used to position and retain a user against the pads. In particular, the outer surface of sidewing 14A of pad 7 includes a "C" shaped channel 29A having a cross section similar to the unitrack shown in FIG. 6 that is fixedly connected to the sidewing 14A. The outer surface of sidewing 14C of pad 8 includes a similar "C" shaped channel 29C fixedly connected to sidewing 14C. One or more ratchets may be slidably coupled to each of the unitrack's 29A and 29C, such as ratchets 21, 23, which are slidably coupled to unitrack 29C, and ratchets 22, 24, which are slidably coupled to unitrack 29A. Each ratchet is coupled to the end of a strap such that two straps 16, 17 may be used to position and restrain a user against the top pads 7, 8, as described in more detail subsequently.

Similarly, two straps 18, 19 may be provided to position and restrain a user against the bottom pad 9. The ends of the straps are coupled to one of the ratchets 25-28. Ratchet 25, 27 are slidably coupled to unitrack 29C', while ratchets 26, 28 are slidably coupled to unitrack 29A'. Unitracks 29A' and 29C' are fixedly connected to carriage sideplates 31, as shown best in FIG. 4 and 5A, via one or more block members or welds as shown schematically at 100B and 100D, respectively. Block members 100B, 100D act as spacers because there is no need for pad 9 to have slidable tracks and/or sidewings since it is fixed relative to carriage 2 in this example. Unitracks 29A' and 29C' also may have a "C"-shaped channel cross section similar to the unitrack illustrated in FIG. 6.

Figure 7:
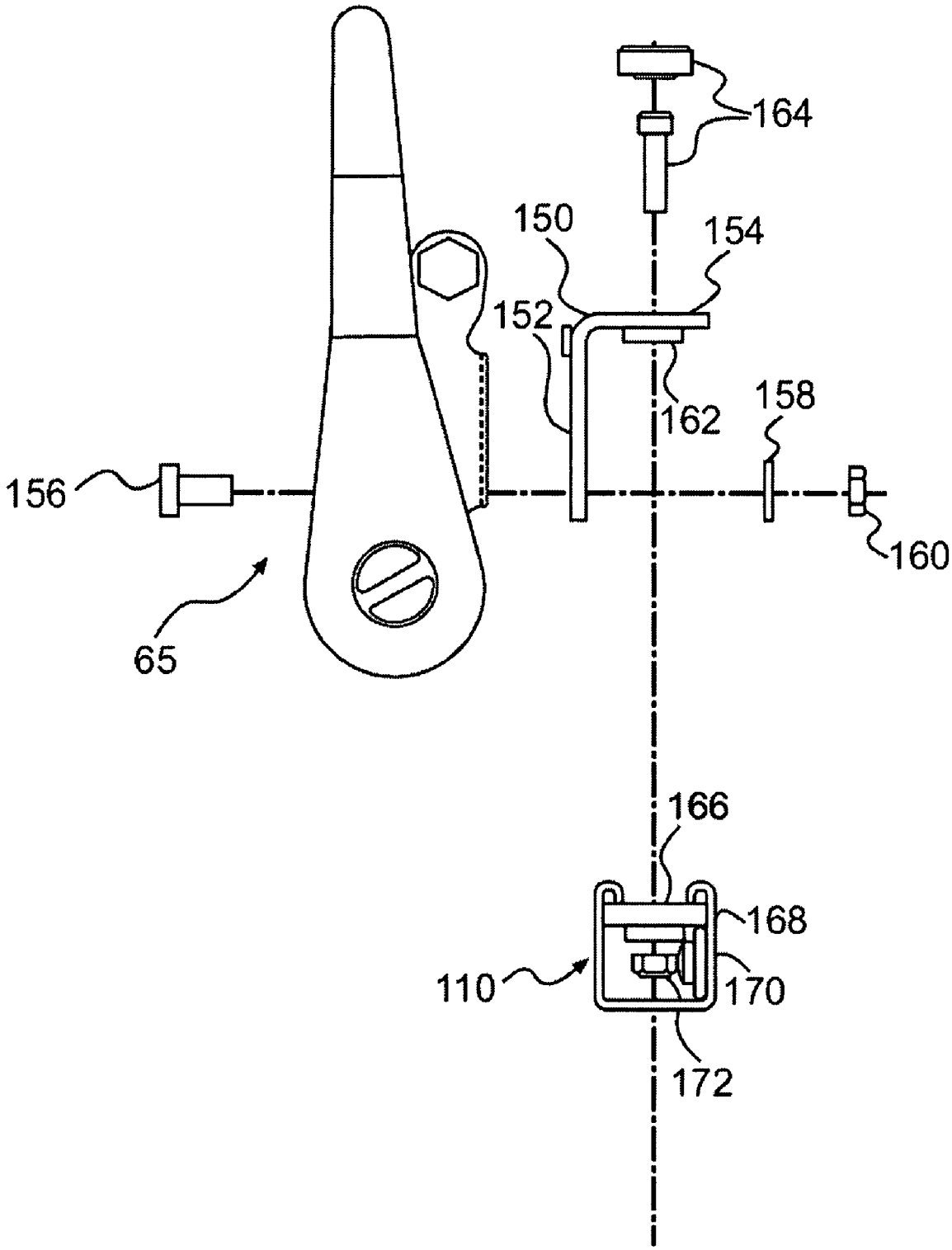
FIG. 7 is an exploded view of a ratchet and unitrack assembly that may be used to adjust the tension and height of the straps of the invention.

The ratchets 21-28 act as leverage points for the straps 16, 17, 18, and 19 on either side of the user. Each ratchet mechanism may include a quick release structure projecting into and captured within the recess of the unitrack's channel to support the ratchet mechanism for sliding movement up and down the length of the unitrack, such as shown in FIG. 7, which is an exploded view of a ratchet and unitrack assembly that may be used to adjust the tension and height of the straps constructed according to the principles to the invention. Ratchet mechanisms 21-28 may have a structure denoted by reference numeral 65 in FIG. 7, and may be secured to a mounting bracket 150. Bracket 150 may be in the form of an angle bracket having L-shaped portions 152, 154. Ratchet mechanism 65 may be secured to L-shaped portion 152 by bolt 156, washer 158, and nut 160. L-shaped portion 154 may include a thru-hole 162. A bolt assembly 164 passes through hole 162, and further through a hole 166 formed in a rectangular washer 168 and through bushing 170, both of which are situated within the unitrack's recess 120. In this manner, nut 172 may be loosely tightened on bolt assembly 164 to retain ratchet mechanism 65 in any number of variable positions relative to its respective unitrack 29.

Washer 168 preferably may be made of polyethylene and frictionally engages inner channel surfaces 114*b*, 116*b* of a "C"-shaped channel section 110 shown in FIG. 6 when nut 172 is tightened on bolt assembly 164. In another embodiment, bushing 170 and nut 172 may be replaced by a rectangular steel nut formed of dimensions similar to washer 168, and having threads to engage bolt assembly 164. Accordingly, ratchet mechanism 65 may slide vertically up or down the unitrack's channel section 110, and be frictionally held in place with respect to the unitrack, thus assisting a user to achieve a pain-free position as previously described. Nut 172 may be loosely tightened on bolt assembly 164 to provide sufficient play such that the weight of ratchet mechanism 65 causes leg 154 to tilt off of a vertical axis. L-shaped portion 154 may then impart a tension force in bolt assembly 164 which in turn pulls washer 168 in friction contact with the unitrack's channel surfaces 114*b*, 116*b* sufficient to hold the ratchet mechanism and attached straps in place. An example of a suitable ratchet is commercially available from A-Belt-Lin Industrial and Trading Co., Ltd., www.abeltc.com, vendor item code TDB-502. Of course, other ratchets, such as ratchets that have smaller widths and greater precision may be employed as discussed below, or other devices may be used to adjust the tension of the holding straps, such as electrically driven stepper motors or the like suitable for adjusting belt length.

Figure 8:
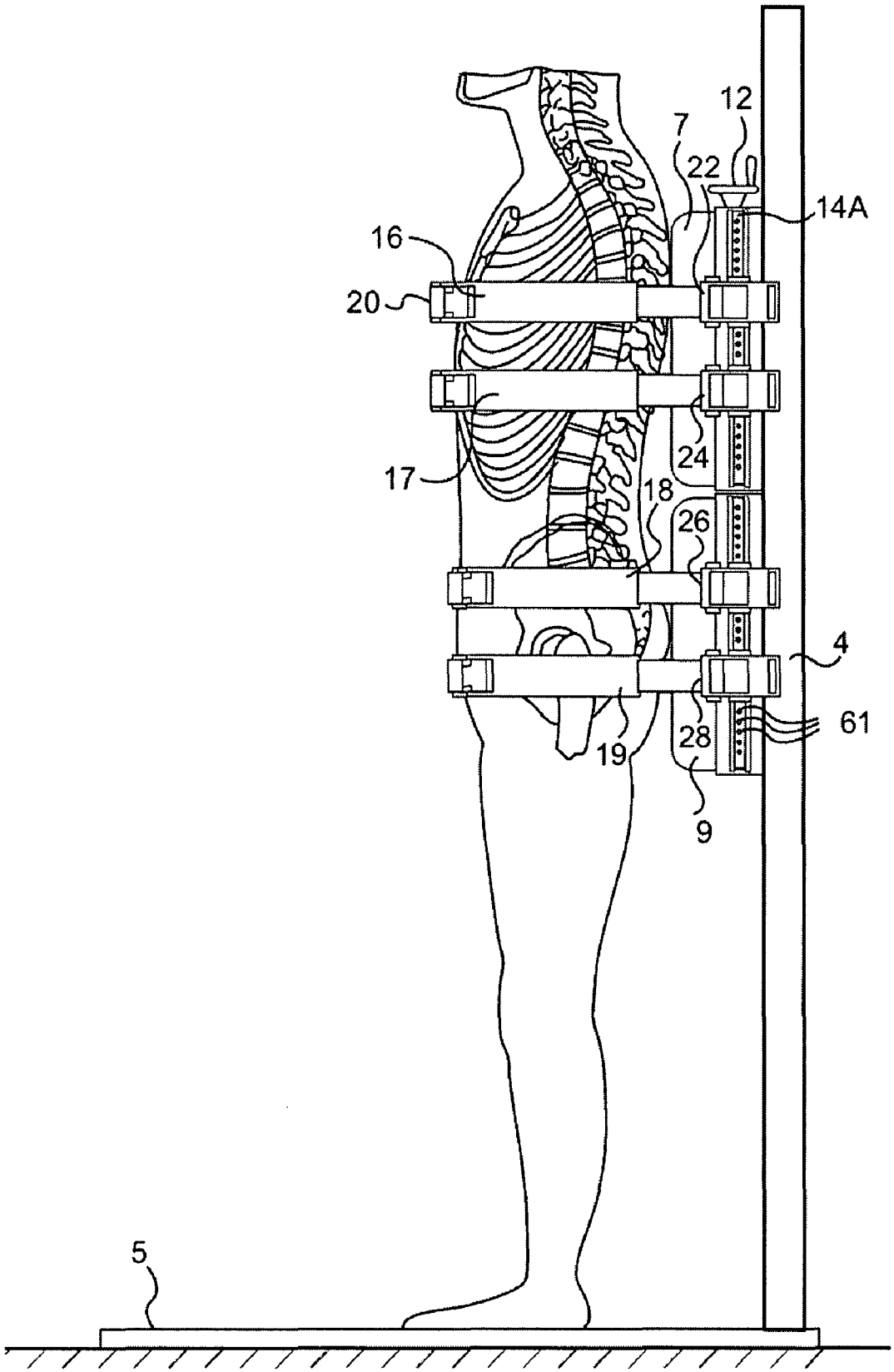
FIG. 8 is a side, partially cross-sectional view of another embodiment of the invention illustrating a sidewing having recesses for adjustably positioning the ratchets of the invention.

Another way to couple the ratchets to the support pads may employ recesses 61, as shown in FIG. 8, formed in a plate (sidewing) attached to the side of each pad. The recesses 61 may be spaced along each sidewing of the pad and configured to receive the ratchets in a releasable manner. The ratchets may be attached to the sidewings by extending a fixing pin through each ratchet into a co-operating recess 61. This enables the location of the ratchets 21-28 to be adjusted up or down along the sidewings and accordingly the position at which the straps 16, 17, 18, and 19 extend around the user may be adjusted to suit a user. Other types of strap position adjustment devices may be employed instead of the recess and pin arrangement.

The ratchets 21-28 enable the clamping tension in the straps 16, 17, 18, and 19 to be selectively and incrementally adjusted by the user, or by another person (such as a supervising clinician), to ensure that the back and/or pelvis of the user are clamped against the support pads 7, 8, and 9 in a substantially pain-free position before performing spinal traction or exercising. It is preferable that each ratchet be able to make fine adjustments of approximately at least 12-13 millimeters, with precision to less than about 7-8 millimeters being preferred, and even finer precision being achievable. Precision to less than about 7-8 millimeters, including to a fraction of a millimeter, while not required, may be achieved by any means known in the art such as stepper motors mentioned above and provides even greater ability to achieve a substantially pain-free position. However, each ratchet could, of course, have courser adjustments than a fraction of a millimeter—for example, approximately two millimeter precision or less, three millimeter precision or less, four millimeter precision or less, five millimeter precision or less, or greater depending upon the application and desired adaptability of the device. Each strap 16, 17, 18, and 19 may have at least two independently adjustable leverage points. As noted above, rather than using ratchets, electronic or other adjustors having the same fine adjustment capability may be employed.

As shown in FIGS. 1, 2, and 3, each of the four straps 16, 17, 18, and 19 or similar harnesses are connected to two of the ratchets 21-28. The straps may be positioned across the width of the device to restrain a user to the device. Straps 16, 17, 18, and 19 may be spaced apart and extend between sidewings 14 and 15 and loop around to another sidewing 14 and 15. However, it will be appreciated that the straps 16, 17, 18, and 19 may be integral with one of the sidewings of a pad and may be releasably attached to the other sidewing of the pad. Alternatively, the straps 16, 17, 18, and 19 may be integral with both sidewings with a fastener 20, such as a buckle, clip, or rope, provided intermediate the ends of each strap 16, 17, 18, and 19 as illustrated in FIG. 1. The fasteners 20 enable the straps 16, 17, 18, and 19 to be quickly and easily opened to release the clamping of the user's back and/or pelvis against the support pads 7, 8, and 9 thus providing for safe use of the device 1. In any event, any known, suitable attachment may be used to connect the straps 16, 17, 18, and 19 to the sidewings 14 and 15.

Also, any suitable number of straps 16, 17, 18, and 19 may be used. Only one, two or three straps, or any number of additional straps could be utilized to restrain additional parts of the body (for example, upper back, neck, arms, legs). The additional straps could be coupled to the device in the same manner as straps 16, 17, 18, and 19. A tension gauge or similar mechanism could also be provided to allow the user to determine the tension in the straps. Further, straps 16, 17, 18, and 19 could also vary in design and arrangement, for example, to aid the user in attaining a pain-free position.

It will be appreciated that straps 16, 17, 18, and 19 each may be independently adjusted up, down, or at different inclinations in a number of ways. First, they may be moved up or down with their respective ratchets and positioned in any number of lockable locations along sidewings 14 and 15. The inclination at which the straps 16, 17, 18, and 19 extend from the sidewings 14 and 15 may also be adjusted by pivoting of the ends of the straps 16, 17, 18, and 19 in the unitracks 29 or recesses 31 with any conventional structure known in the art.

The clamping tension in the straps 16, 17, 18, and 19 may be adjusted by means of, for example, a ratchet mechanism, as discussed above or other structure known in the art. The tension in the straps 16, 17, 18, and 19 may also be adjusted using the fasteners 20 positioned intermediate the ends of the straps 16, 17, 18, and 19. Using any adjustment mechanism, it is preferred that the mechanism keep the straps 16, 17, 18, and 19 under tension and permit the straps to be incrementally tightened without releasing the tension. Adjusting the clamping tension in either side of each strap rotates the back and/or pelvic areas width-wise along the user's body, i.e. about a generally vertical axis. A different rotational motion of the back and/or pelvis are caused by adjusting the location of the ratchets along the sidewings 14 and 15 in combination with adjustments to the tensions of straps 16, 17, 18, and 19. Changes in the difference in tension between straps 16, 17, 18, and 19 causes the back and/or pelvis to rotate length-wise along the user's body, i.e. about a generally horizontal axis.

The straps 16, 17, 18, and 19 are preferably formed of a tough, flexible, and durable material, similar to or the same as the fibrous material from which conventional airline or automobile seat belts are made. Soft foam pads or wedges may be provided on the contact side of straps 16, 17, 18, and 19 for enhanced comfort when the straps 16, 17, 18, and 19 are securely clamped around the user. Straps 16, 17, 18, and 19 may have a high coefficient of friction coating, such as a rubbery finish, to prevent slippage of the straps 16, 17, 18, and 19 relative to the user's clothing and/or body.

To comfortably secure a person to the device 1 using the straps 16, 17, 18, and 19, the support pads 7, 8, and 9 may optionally include wedges or bolsters that are releasably attached to the support pads 7, 8, and 9 by means of hook and pile fastener material, such as Velcro®. The wedges or bolsters may be selectively arranged on the support pads 7, 8, and 9 to ensure that the user is in a comfortable, pain free position while clamped against the support pads 7, 8, and 9.

Support pads 7, 8, and 9 are preferably made of a resilient material, such as foam or rubber, to provide a sufficiently solid surface against which the user's back and pelvis are to be clamped. Further, support pads 7, 8, and 9 may be sufficiently wide to extend across the entire width of the user's back and pelvis. The support pads 7, 8, and 9 may be contoured to accommodate the shape of a back, pelvis, and differently shaped support pads may be provided to suit a range of anatomies. Support pads 7, 8, and 9 may include a rigid backing, such as plywood, covered with high density polyurethane foam, which in turn may be covered with low density polyurethane foam. A vinyl covering may cover the foams. Other suitable padding and covering materials may be employed.

Pads 7, 8 and 9 are shown as relatively flat pads. However, one or more of the pads could be shaped or angled to conform to the user as mentioned above, or to provide pressure points. Wedges could also be coupled to the pads to provide the same effect. Extensions could also be added above, below, or to the sides of the pads. The extensions could be hinged to the pad so that they can be angled towards or away from the user. The angle of inclination of the support pads 7, 8, and 9 may be adjusted by any suitable mechanism. In addition, bolsters or wedges may be placed between the restraining straps and the user of the device and/or under one or both feet. The bolsters and wedges may be employed to create an angulation of the back or pelvis, which may be useful in locating a pain-free position.

As discussed above, to position oneself with the device, the user steps on the base 5 and orients herself/himself into a substantially pain-free position with his/her front, back (spine) and/or pelvis against the support pads 7, 8, and 9. To restrain oneself to the device, the user (or an assistant) detaches one end of the straps 16, 17, 18, and 19 from the sidewings 14, 15 and reattaches the straps 16, 17, 18, and 19 on the other sidewings 14, 15. Alternatively, if the straps 16, 17, 18, and 19 are integral with both sidewings 14, 15, the fastener 20 intermediate the end of the straps 16, 17, 18, and 19 is operated to securely restrain the user with the straps 16, 17, 18, and 19.

Typically, the straps 16, 17, 18, and 19 are placed around the front, back and/or lumbopelvic region of the user to restrain the user in a position that the user is substantially free of any pain or discomfort. For example, strap 16 may extend around a higher part of the user's back, and strap 17 may extend around a lower part of the user's back. Then, straps 18 and 19 are positioned lower than strap 17 on the user's body around the user's pelvis. The straps 16, 17, 18, and 19 may also extend around the user at any point on the user's body as long as the user is securely clamped against the support pads 7, 8, and 9. It will be appreciated that the desired clamped position varies depending on the particular user and the desired location for spinal traction. Thus, the straps 16, 17, 18, and 19 may be placed above or below the users pelvis, or at any other anatomical area as determined by the user or clinician. The adjustability of the device 1 in this manner provides flexibility enabling its use in any of a number of conditions and different body areas that can cause people pain, discomfort and/or decreased quality of movement.

As demonstrated, support pads 7, 8 may be adjusted independently of one another. This enables the user to achieve a substantially pain-free position against the support pads 7, 8 despite any lack of symmetry in the back or pelvis, as frequently occurs in the non-ideal anatomies of actual users. Independent adjustments are particularly advantageous if the support pads 7, 8 are contoured, as it is important that the user's back and/or pelvis are aligned with the pre-formed contours to prevent discomfort.

Moreover, the user may rotate his pelvis about an axis perpendicular to the front surface of the support pads 7, 8 and 9 while raising or lowering one leg and then tensioning the straps to hold this position. The user may stand on a bolster, wedge or other support to facilitate positioning in the desired orientation. Using all of ratchets 21, 22, 23, 24, 25, 26, 27 and 28 in combination helps the user to reposition the back and/or pelvic area until reaching a substantially pain-free position. Preferably, the ratchets 21, 22, 23, 24, 25, 26, 27 and 28 are tightened or loosened one at a time until a substantially (or completely) pain-free position is found. This ensures that the subsequent exercises have a maximum therapeutic effect on the user.

In this example, the device 1 helps the user reach a substantially pain-free position and apply specific vertebral segment traction. This is achieved by permitting the back and/or pelvic regions to move in six degrees of freedom to achieve a substantially pain-free position and then restraining specific back and/or pelvic regions against support pads 7, 8, and 9 with straps 16, 17, 18, and 19. The support pads 7 and/or 8 are then moved vertically relative to the support pad 9. As a result, traction is applied to the body portions between straps 17 and 18. Thus, the device 1 provides for three-dimensional adjustment capability which substantially increases the likelihood of finding a substantially pain-free position or increasing the number of such positions. The adjustments can be accomplished incrementally while the user is completely or at least partially secured against support pads 7, 8, and 9 by straps 16, 17, 18, and 19. Hence, the user can reposition himself or herself even after initially restraining the back and/or pelvis. Once a substantially pain-relieving position is found, all of the ratchets 21, 22, 23, 24, 25, 26, 27 and 28 are tightened evenly to maintain the substantially pain-free position and prevent the back and pelvic regions from returning to a more painful position.

In summary, once the user positions and restrains himself/herself to the device in a substantially pain-free position, one or both of the support pads 7, 8 may be moved by operating one or both of the cranks 12, 13 to apply spinal traction. The user then may reposition himself/herself in the device in another substantially pain-free position. Then, the user may restrain himself/herself to the device in the new position, and reapply spinal traction. These steps may be repeated any number of times to increase the number of substantially pain-free positions that may be found, to decrease the amount of pain and/or to reapply traction to numerous portions of the spine.

In addition, when a substantially pain-free position has been achieved, the user can then exercise his/her back or other body parts, often without assistance or intervention from another person, for example by bending forward or to the sides or raising a leg. Thus, unlike manual mobilization techniques performed by a clinician, the invention enables the user to exercise using his/her own muscles. The straps 16, 17, 18, and 19 and/or the support pads 7, 8 and 9 may be adjusted during the exercise session to ensure that the user is in a substantially pain-free position throughout the session.

In general, exercises facilitate pivoting of portions of the lumbar spine about the pelvis, or pivoting of the leg about the pelvis. They may also facilitate movement of some parts of the spine while restricting movements in other parts of the spine. This pivoting may help relocate any fault that may have developed in the pathological position of the lumbar spine relative to the pelvis at the sacroiliac joint and/or of the leg relative to the pelvis at the hip joint. By exercising with portions of the pelvis securely clamped in a pain-free position, the spine, and/or the pelvis, and/or the hip-joint may become correctly re-aligned. The exercising may additionally or alternatively include twisting or rotational movements, stretching movements, flexing or extending movements, the lifting of exercise weights, sideways bending, or any other suitable exercise, as prescribed for the user by a clinician, for example. It is believed that having the user use his/her own muscles to perform the exercises in a pain-reduced environment may induce certain beneficial neurological and/or muscular responses, not possible with manual mobilization techniques, that facilitate healing and/or pain reduction. Specific examples of exercises and devices to enhance exercises are described below in connection with the description of FIGS. 9, 10A and 10B.

After applying spinal traction and/or exercising, the straps 16, 17, 18, and 19 may be detached from the ratchets 21, 22, 23, 24, 25, 26, 27 and 28 or the fastener 20 may be opened and the user may then step away from the support pads 7, 8, and 9 and off the base 5. It has been found that after such a spinal traction and/or exercise session, the reduced pain feeling or substantially pain-free feeling experienced by the user while clamped to the support pads 7, 8, and 9 persists, in some cases for extended periods of time.

Figure 9:
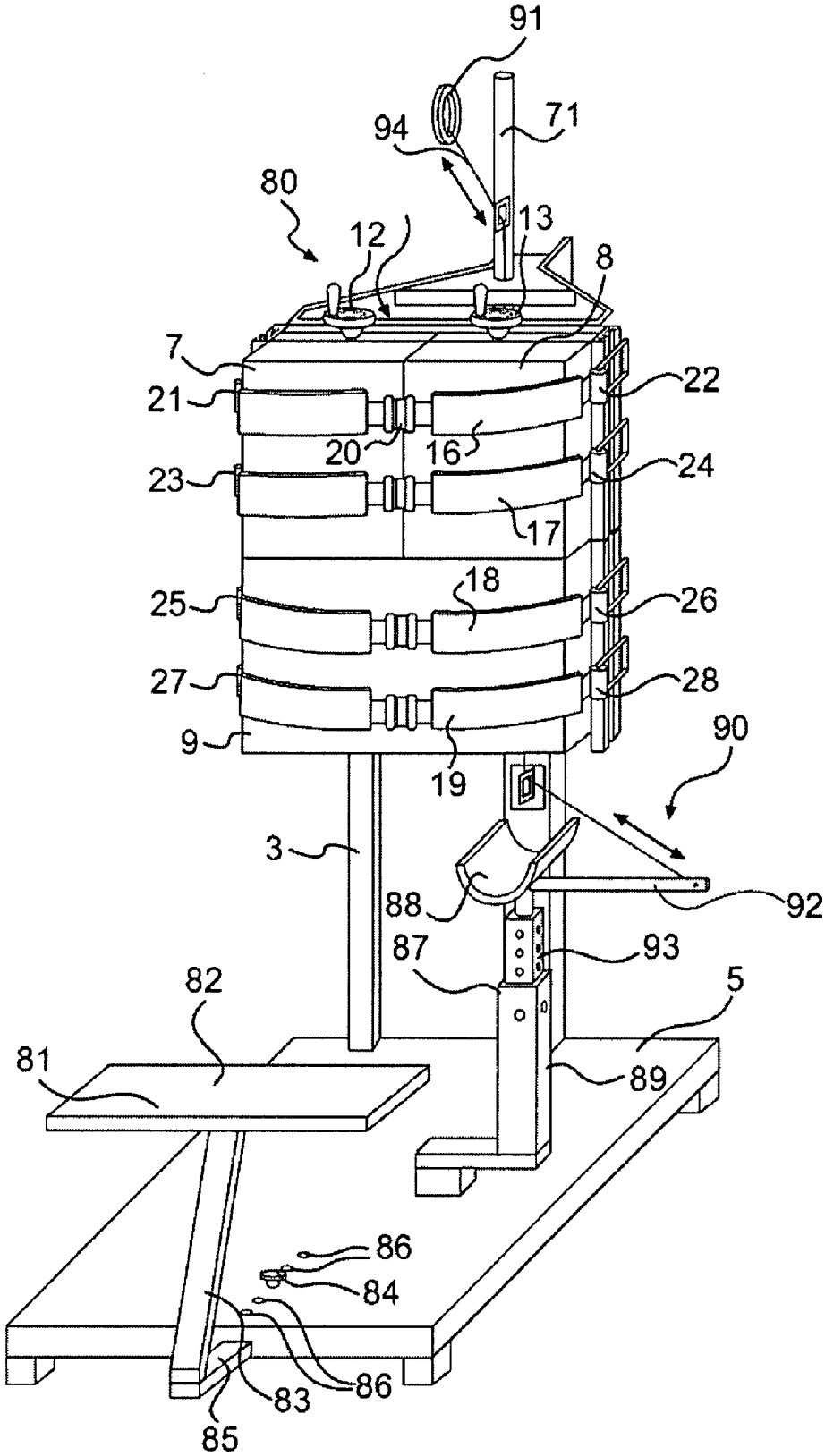
FIG. 9 is a perspective view of another embodiment of a restraint, reposition, traction, and exercise device constructed according to the principles to the invention having auxiliary exercise equipment.

FIG. 9 illustrates another example of a restraint, reposition, traction, and exercise device 80 constructed according to the invention. Device 80 includes at least one leg/foot mounting to assist exercising of the leg of the user. For example, device 80 may include a footstool 81 to assist in exercising the user's leg. The footstool 81 has a foot platform 82 supported above base 5 by a stem 83. The stem 83 is releasably fixed to base 5 by means of a fixing pin 84 which passes through a hole 86 in base 5 into a root portion 85 of the stem 83 which is located beneath base 5. A plurality of holes 86 located in base 5 facilitate adjustment of the position of footstool 81 to suit the user.

When the user's back and pelvis have been clamped against the support pads 7, 8, 9 in the substantially pain-free position, the foot of the user is placed upon the platform 82. Footstool 81 may then be used to assist in exercising the user's leg, for example by pressing down on the platform 82 with the foot during extension of the leg.

The device 80 also may include a pivotable leg support 87 for twisting the leg 40 of the user. The leg support 87 has a curved support pad 88 substantially parallel to the base 5 for supporting a knee or lower leg of the user, the support pad 88 being held above the base 5 by a stem 89. The support pad may take on other shapes, such as a V-shape, which has been found to increase friction between the user's leg and the leg support 87 and facilitate the exercises described below. The height of the stem 89 is selectively adjustable to suit the user by means of a telescoping arrangement of an inner portion of the stem 89 within an outer portion of the stem 89. The support pad 88 is rotatable relative to the stem 89 for exercising the leg 40 of the user by twisting.

A connector 90 is provided to facilitate pivoting of the support pad 88, thereby twisting of the user's leg. One end of the connector 90 is attached to the support pad 88 and the other end has a handle 91 for gripping by the user. The connector 90 is passed from the support pad 88 through a series of eyelets on the leg 93 to locate the handle 91 above the support pads 7 and 8. A lever arm 92 is provided to attach the connector 90 to the support pad 88, the connector 90 being attached to the end arm 92 that is farther from the pivot axis of the support pad 88. This arrangement increases the mechanical advantage of the system when a user pulls on the connector 90 to pivot the support pad 88 and thus twist the user's leg.

When the user's back and pelvis have been securely clamped against the support pads 7, 8, and 9 in a substantially pain-free position, the user bends one knee and rests the bent knee in the support pad 88. By pulling on the connector 94 at the handle 91, which is supported by support pole 71 which is in turn may be coupled with the carriage 2, the support pad 88 is pivoted about the stem 89, and thereby the leg of the user is twisted. This twisting action will have a therapeutic effect on the user.

In this embodiment, because the user's pelvis is securely clamped against the support pads 7, 8, and 9 by the straps 16, 17, 18, and 19 during exercise, substantially all movement of the user's leg is translated into a pivoting of the user's leg about the user's pelvis, which remains fixed. The pelvis clamping arrangement of the straps 16, 17, 18, and 19 substantially prevents pivoting of the pelvis about the sacroiliac joint and lumbar spine during the leg exercise, as would normally occur if the pelvis was unconstrained. By mobilizing the leg to pivot about the pain-free positioned pelvis, the exercise has a therapeutic effect on the user.

It will be appreciated that the leg support 87 may be provided at any location on the base 5 for twisting of either of the user's legs. Additionally, connector 90 may be eliminated and arm 92 extended to form approximately a right angle such that its end that is farthest from support pad 88 is substantially perpendicular to the base 5 and within reach of an arm of user. The support pad 88 may be pivoted by alternative actuating means, such as by an electro-mechanical means or by any other suitable means. Suitable controlling means may be provided for controlling the pivoting of the support 88.

Figure 10A:
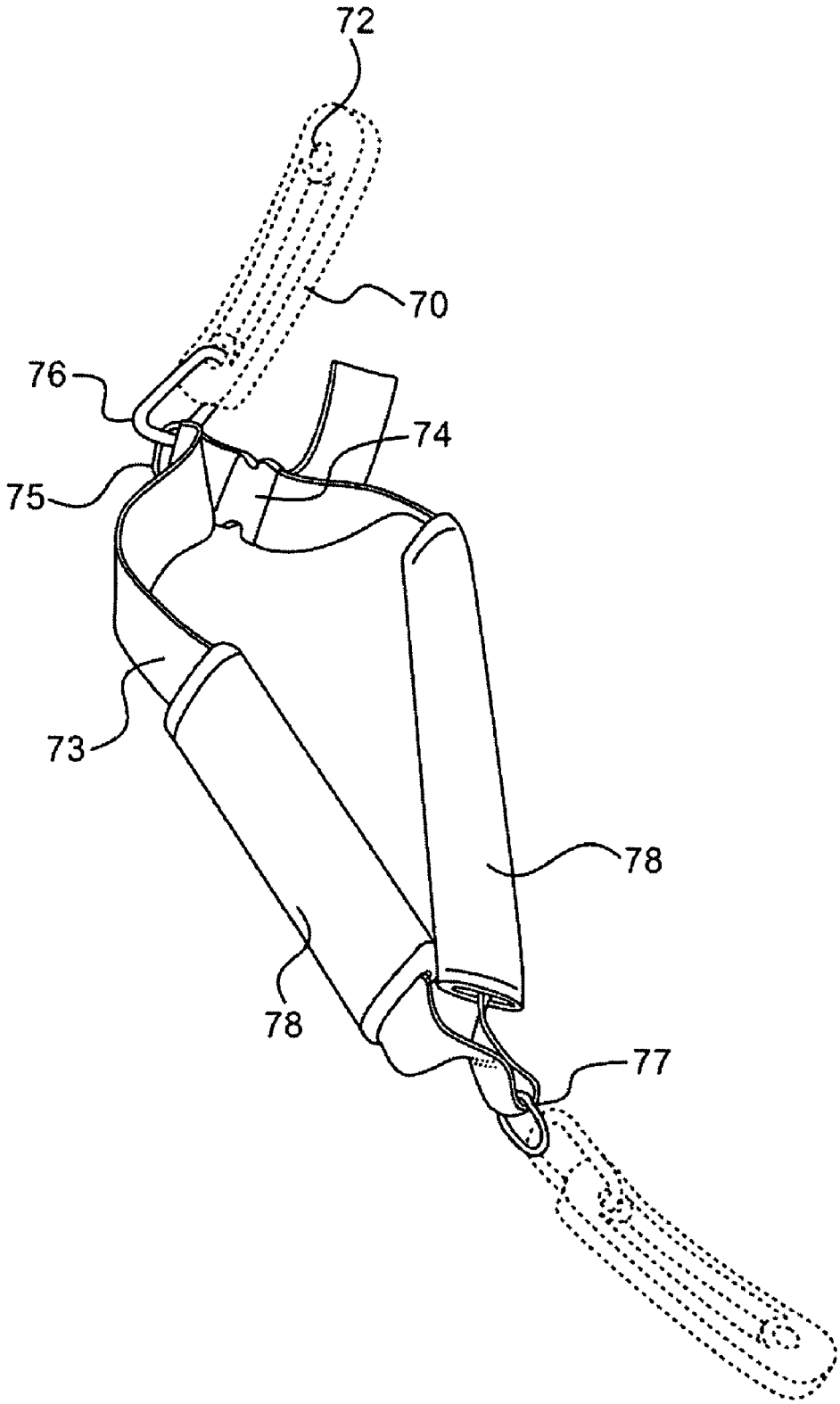
FIG. 10A is a perspective view of an exercise strap that may be used with the invention.

In another embodiment of the invention, an exercise strap having one or more resilient arms 70, as shown in dashed lines in FIG. 10A, may be used to perform additional exercises using the device 1. Resilient arm 70 may be formed from rubber or other suitable material that can be used to provide for resistance to the user exercising on device. Resilient arm 70 may include a hole 72 at one end and a ring 76 at the other. It may be supported by support pole 71, described earlier with reference to FIG. 9. Arm 70 is coupled to support pole 71 by placing the hole 72 over the pole 71. Arm 70 is attached to the user by means of a strap 73 connected to the arm 70 via ring 76. The strap 73 includes a buckle 74 for adjusting the tension in the strap 73. The buckle 74 also facilitates opening the strap 73 to release the user. In this example, strap 73—unlike resilient arm 70—is made of a comparatively inelastic material, such as conventional seat belt material.

Figure 10B:
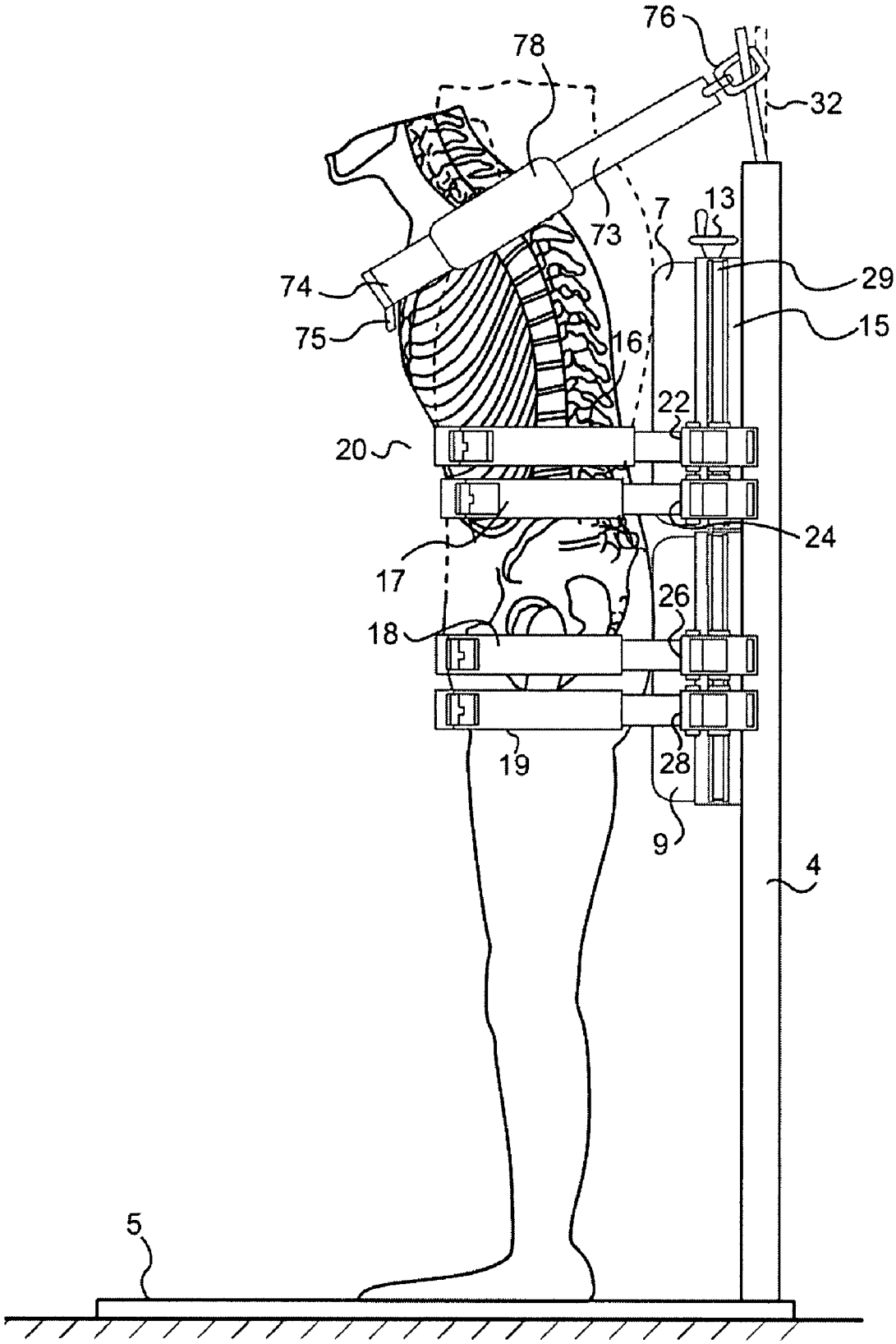
FIG. 10B is a side view of the exercise strap of FIG. 10A in use with the device of FIG. 8.

Alternatively, the arm 70 may be coupled to a hole in a support plate, such as plate 32 shown in FIGS. 1-3, 10B. Plate 32 may be a spring bar, preferably formed of a resilient material, such as heat-treated spring steel, such that non-resilient strap 73 may be used in place of the resilient arms 70. A non-resilient ring 76 may be attached between strap 73 and plate 32, as shown in FIG. 10B, to allow a user to exercise against the resistance provided by flex plate 32. In a further alternative, resilient arm 70 could be replaced by a modified strap serving the functions of strap 73 and resilient arm 70. In this case, the modified strap includes a resilient material to provide the resistance to the user exercising on device that otherwise would have been provided by arm 70.

As illustrated in FIG. 10A, two connectors may be provided along strap 73 for releasably attaching strap 73 to optional arm 70. The connectors may be in the form of rings 75, 77 for releasable inter-engagement with ring 76 carried by arm 70. One ring 75 is substantially adjacent buckle 74 on strap 73, and the other ring 77 is substantially opposite buckle 74. When using the device, the user may be clamped with the rear of the pelvis against support pads 7, 8, and 9 (FIG. 10B). When the rear of the pelvis is clamped against support pads 7, 8, and 9, strap 73 may be attached to plate 32 by ring 76. In this way, buckle 74 is again located to the front of the user (FIG. 10B) for ease of opening and closing of buckle 74 by the user.

Strap 73 is of a suitable strong, durable material and may include soft pads 78 to prevent discomfort to the user when strap 73 is in use. When the user's pelvis is securely clamped against support pads 7, 8, and 9 in a substantially pain-free position, strap 73 is attached to arm 70 and strap 73 is extended around the chest of the user. Buckle 74 may then be closed and the tension in strap 73 may be adjusted to suit the user. When the user performs exercises, for example bending backwards or forwards, resilient arm 70 or plate 32 provides resistance to the exercising. Exercising of the user's back against the resistance force of arm 70 or plate 32 has a therapeutic effect on the user.

Further, because portions of the user's pelvis is securely clamped against the support pads 7, 8, and 9 by straps 16, 17, 18, and 19 during exercise of the back, substantially all movement of the user's back is translated into a pivoting of the user's spine about the user's pelvis, which remains fixed. The pelvis clamping arrangement of the straps 16, 17, 18, and 19 substantially prevents pivoting of the pelvis about the hip joint during the back exercise, as would normally occur if the pelvis was unconstrained. By mobilizing the lumbar spine to pivot about the substantially pain-free positioned pelvis, the exercise has a therapeutic effect on the user.

A tension gauge may be added to the resistance band and connected to a computer, processor and/or monitor to provide the user with feedback as to the amount of tension, the number of repetitions performed, etc., and/or for data collection. Alternative means of resistance to exercising of the user may be provided, alternatively or additionally to the resilient arm 70. For example, exercise weights may be attached to the user, for example by means of a suitable pulley arrangement, to provide a resistance force against user movement.

Although the above descriptions are directed to various embodiments of the invention, other variations and modifications may be made without departing from the spirit and scope of the invention. For example, the devices in the accompanying Figures may be configured for use by a user to allow decompression of body parts in a variety of positions including substantially horizontal, substantially upright (vertical) or any angled position between vertical and horizontal. For example, the device may be provided on, or as part of, a treatment table or bed. Alternatively the device may be configured for use by a user inclined at any suitable angle. The angle may be selectively adjustable to suit the needs of the user. The device also may be configured for use by a user in a seated position. For example, a seat could be placed below the carriage 2 shown in FIG. 10B. The support pads 7, 8 could be movable in any direction and subject to gravity or mechanical forces to move, or to variable resistance forces provided by, for example, suitable springs, elastic bands or a pulley system with weights.

In another example, any of the disclosed devices could be altered to include a processor, software and a read-out device. The device could be programmed to provide workout routines, instructions, treatment charts, to monitor the treatments and the user (e.g., heart rate, blood pressure, body temperature), or even to provide audio or visual entertainment.

The devices disclosed in the accompanying Figures also could be used with a person who is clamped with the front or side of his/her pelvis against the support pads, instead of the back of his/her pelvis, as illustrated in the drawings.

Although the devices of the accompanying Figures may be used to treat a person suffering from back pains or disorders (e.g., back disorder in the region of the cervical spine/thoracic spine/lumbar spine/sacro-iliac joint/pelvis/knees/hip-joint), they may be used in other ways and for other purposes. Indeed, rather than restraining the back and pelvis, other parts of the body could be stabilized, including the thoracic spine, chest, and shoulder regions. After immobilizing, for example, the chest, the pelvis could be exercised. After immobilizing the shoulder area, arm exercises could be performed. The devices need not even be used for therapeutic purposes or by a person suffering from back discomfort. It could be used as a prophylactic device to help prevent back complaints or back disorders from developing. The invention can also be used for strength and flexibility purposes, for example, to increase range of motion, such as in a golfer's entire swing; or even as a warm-up or cool-down in conjunction with another exercise routine or athletic activity.

Again, these examples are merely illustrative and are not meant to be an exhaustive list of all possible designs, implementations, modifications, and uses of the invention. Moreover, features described in connection with one embodiment of the invention maybe used in conjunction with other embodiments, even if not explicitly stated above.

While the invention has been described in terms of exemplary embodiments, those skilled in the art will recognize that the invention can be practiced with modifications in the spirit and scope of the appended claims. These examples given above are merely illustrative and are not meant to be an exhaustive list of all possible designs, embodiments, applications or modifications of the invention.

What is claimed is:

1. A spinal restraint, traction and exercise device comprising:

a first support surface movable in a substantially linear direction and configured to support a first portion of a person, wherein the first portion of the person includes a portion of the pelvic region and/or a lower torso portion of the person;

a first restraint to secure the first portion of the person against said first support surface;

a second support surface to support a second portion of the person, wherein the second portion of the person is spaced above the first portion of the person, and said second support surface including at least two sections individually and independently movable in a substantially linear direction relative to said first support surface;

a second restraint to secure the second portion of the person against said second support surface, said first and second restraints permitting positioning and repositioning of the person against said support surfaces in any of a number of three-dimensional orientations; and an adjustment mechanism to move said second support surface in a substantially linear direction away from said first support surface to apply a spinal traction force.

2. The device of claim 1, wherein at least one said support surfaces is configured to support the person in a substantially horizontal, substantially vertical, or an angled position.

3. The device of claim 1, further comprising a locking mechanism configured to keep said first and said second support surfaces apart and maintain a spinal traction force between the first portion and second portion of the person.

4. The device of claim 3, wherein said locking mechanism comprises a self-locking threadable connection forming at least a part of said adjustment mechanism.

5. The device of claim 3 wherein said locking mechanism is operable to keep said first and second support surfaces apart in a number of spaced positions.

6. The device of claim 1, wherein said second support surface is movable along a track system.

7. The device of claim 6, wherein said adjustment mechanism includes an actuator arranged to move said second support surface along said track system.

8. The device of claim 7, wherein said actuator comprises at least one of a manually operated mechanism and an electric motor.

9. The device of claim 1, wherein said at least two sections include a right section and a left section.

10. The device of claim 9, wherein at least one of said right section and said left section is movable along a track system away from said first support surface to apply a traction force between the first portion and second portion of the person.

11. The device of claim 1, wherein said adjustment mechanism includes at least two actuators, each actuator being operable to move one of said two sections.

12. The device of claim 1, wherein tension in at least one of said first restraint and said second restraint is adjustable.

13. The device of claim 1, further comprising a third restraint configured to be engaged between the person and a connection portion of said device wherein at least one of said third restraint and said connection portion provide resistance against which the person is able to exercise.

14. The device of claim 1, wherein each of said first and second restraints comprises a pair of restraining members.

15. The device of claim 1, wherein said support surfaces comprise cushioned pads.

16. The device of claim 1, wherein at least one of said support surfaces is angularly adjustable.

17. The device of claim 16, further comprising at least one of i) wedges disposed between said at least one support surface and the person; and ii) a mechanism to pivot said at least one support surface about a substantially horizontal axis.

18. The device of claim 1, wherein the substantially linear direction is substantially vertical.

19. The device of claim 1, wherein said first support surface is movable in a substantially linear direction relative to said second support surface.

20. The device of claim 1, wherein said first support surface is movable in a substantially linear direction relative to a support structure to adjust the position of said first support surface relative to the height of the person.

21. The device of claim 20, further comprising a carriage carrying said first and second support surfaces, said carriage being arranged on and movable with respect to the support structure to adjust the position of said carriage relative to the height of the person, and wherein said first support surface is fixedly connected to the carriage and movable in a substantially linear direction by virtue of its attachment to said movable carriage.

22. A spinal restraint, traction and exercise device comprising:

a first support surface configured to support a first portion of a person in a substantially vertical position;

a first restraint to secure the first portion of the person against said first support surface;

a second support surface to support a second portion of the person in a substantially vertical position and being moveable in a substantially linear direction;

a second restraint to secure the second portion of the person against said second support surface, said first and second restraints permitting positioning and repositioning of the person against said support surfaces in any of a number of three-dimensional orientations;

an adjustment mechanism to move said second support surface in a substantially linear direction away from said first support surface to apply a spinal traction force;

a carriage carrying said first and second support surfaces, said carriage being arranged on and movable with respect to a support structure to adjust the position of said carriage relative to the height of the person; and a track system including at least one track fixed to said support structure and at least one track fixed to one of said first and second support surfaces, and wherein said tracks matingly fit together to guide movement of said first and second support surfaces relative to one another.

23. The device of claim 22, wherein said first and second restraints may be independently adjusted relative to the height of the person and relative to said support structure.

24. The device of claim 22, wherein each of said restraints includes at least one connection connecting the restraint to said support structure, said at least one connection allowing for independent adjustments in the tension of the respective restraint.

25. The device of claim 24, wherein said at least one connection comprises a ratchet mechanism allowing for adjustments to be made to a precision of at least about 7 to 8 millimeters or less without release of any tension in the restraint.

26. A spinal restraint, traction and exercise device comprising:

a first support surface configured to support a first portion of a person, wherein the first portion of the person includes a portion of the pelvic region and/or a lower torso portion of the person;

a first restraint to secure the first portion of the person against said first support surface;

a second support surface to support a second portion of the person, wherein the second portion of the person is spaced above the first portion of the person, and said second support surface including at least two sections individually and independently movable in a substantially linear direction relative to said first support surface;

a second restraint to secure the second portion of the person against said second support surface, said first and second restraints permitting positioning and repositioning of the person against said support surfaces in any of a number of three-dimensional orientations; and an adjustment mechanism to move said second support surface in a substantially linear direction away from said first support surface to apply a spinal traction force;

wherein said second support surface may be raised or lowered with respect to said first support surface to maintain the restrained portions of the person's body in a substantially pain-free position while applying spinal traction.

27. A spinal restraint, traction and exercise device comprising:

first means for supporting a first portion of a person in a first position, wherein said first means for supporting the first portion of the person comprises a cushioned pad, and wherein the first portion of the person includes a portion of the pelvic region and/or a lower torso portion of the person;

first means for restraining the first portion of the person;

second means for supporting a second portion of the person, wherein said first means for supporting the first portion of the person comprises a cushioned pad, and wherein the second portion of the person is spaced above the first portion of the person;

second means for restraining the second portion of the person including at least two sections individually and independently movable in a substantially linear direction relative to the first means for supporting the first portion of the person, said first and second means permitting positioning and repositioning of the person in any number of three-dimensional orientations; and means for moving said first supporting means in a substantially linear direction relative to said second supporting means to apply a spinal traction force.

28. The device of claim 27, wherein at least one said first and second supporting means is configured to support the person in a substantially horizontal, substantially vertical, or an angled position.

29. The device of claim 27, further comprising means for locking said first and second supporting means in a spaced position to maintain application of the spinal traction force.

* * * * *